US007429927B2

(12) United States Patent
Bonalle et al.

(10) Patent No.: US 7,429,927 B2
(45) Date of Patent: Sep. 30, 2008

(54) SYSTEM AND METHOD FOR PROVIDING AND RFID TRANSACTION DEVICE

(75) Inventors: David S Bonalle, New Rochelle, NY (US); Gail A Francolini, Fairfield, CT (US); Samantha S Ing, New York, NY (US); Danielle Kunian, New York, NY (US); Danielle R Nulle, Atlantic Highlands, NJ (US)

(73) Assignee: American Express Travel Related Services Company, Inc., New York, NY (US)

( * ) Notice: Subject to any disclaimer, the term of this patent is extended or adjusted under 35 U.S.C. 154(b) by 340 days.

(21) Appl. No.: 11/161,105

(22) Filed: Jul. 22, 2005

(65) Prior Publication Data

US 2005/0248459 A1 Nov. 10, 2005

Related U.S. Application Data

(63) Continuation-in-part of application No. 10/746,781, filed on Dec. 24, 2003, and a continuation-in-part of application No. 10/192,488, filed on Jul. 9, 2002, now Pat. No. 7,239,226, application No. 11/161,105.

(60) Provisional application No. 10/340,352, filed on Jan. 10, 2003, provisional application No. 60/304,216, filed on Jul. 10, 2001, provisional application No. 60/396,577, filed on Jul. 16, 2002.

(51) Int. Cl.
*G08B 13/14* (2006.01)

(52) U.S. Cl. ..... 340/572.8; 340/572.9; 340/10.1; 340/5.61; 340/5.4

(58) Field of Classification Search ..... 340/572.8, 340/572.1, 572.9, 572.7, 568.1, 10.1, 5.8, 340/551, 5.61, 5.4; 235/492; 380/270, 44
See application file for complete search history.

(56) References Cited

U.S. PATENT DOCUMENTS

| | | | |
|---|---|---|---|
| 3,376,661 | A | 4/1968 | Hulett |
| 3,914,762 | A | 10/1975 | Klensch |
| 4,066,873 | A | 1/1978 | Schatz |
| 4,206,965 | A | 6/1980 | McGrew |
| 4,303,904 | A | 12/1981 | Chasek |
| 4,318,554 | A | 3/1982 | Anderson et al. |

(Continued)

FOREIGN PATENT DOCUMENTS

| | | |
|---|---|---|
| CH | 689680 | 8/1999 |

(Continued)

OTHER PUBLICATIONS http://www.semiconductors.phillips.com/news/content/file_878.html, Apr. 7, 2003.

(Continued)

*Primary Examiner*—Anh V La
(74) *Attorney, Agent, or Firm*—Snell & Wilmer L.L.P.

(57) ABSTRACT

A system and method for attaching a Radio Frequency operable transaction device to an article using various attachment apparatus are disclosed. The invention includes attaching a transaction device to an article using apparatuses comprised of bands, clips, clamps, drawstrings, and adhesives. The present invention allows for the securing of an RF transaction device (e.g., a payment fob) to a consumer's person thereby enabling a transaction to be completed without the need for the consumer to manually present the transaction device.

16 Claims, 18 Drawing Sheets

U.S. PATENT DOCUMENTS

| | | | |
|---|---|---|---|
| 4,421,380 | A | 12/1983 | McGrew |
| 4,443,027 | A | 4/1984 | McNeely et al. |
| 4,475,308 | A | 10/1984 | Heise et al. |
| 4,583,766 | A | 4/1986 | Wessel |
| 4,589,686 | A | 5/1986 | McGrew |
| 4,593,936 | A | 6/1986 | Opel |
| 4,639,765 | A | 1/1987 | dHont |
| 4,656,463 | A | 4/1987 | Anders et al. |
| 4,663,518 | A | 5/1987 | Borror et al. |
| 4,672,021 | A | 6/1987 | Blumel et al. |
| 4,700,055 | A | 10/1987 | Kashkashian, Jr. |
| 4,717,221 | A | 1/1988 | McGrew |
| 4,736,094 | A | 4/1988 | Yoshida |
| 4,739,328 | A | 4/1988 | Koelle et al. |
| 4,744,497 | A | 5/1988 | O'Neal |
| 4,795,894 | A | 1/1989 | Sugimoto et al. |
| 4,829,690 | A | 5/1989 | Andros |
| 4,837,422 | A | 6/1989 | Dethloff et al. |
| 4,839,504 | A | 6/1989 | Nakano |
| 4,849,617 | A | 7/1989 | Ueda |
| 4,884,507 | A | 12/1989 | Levy |
| 4,918,432 | A | 4/1990 | Pauley et al. |
| 4,961,142 | A | 10/1990 | Elliott et al. |
| 4,984,270 | A | 1/1991 | LaBounty |
| 4,998,753 | A | 3/1991 | Wichael |
| 5,023,782 | A | 6/1991 | Lutz et al. |
| 5,053,774 | A | 10/1991 | Schuermann et al. |
| 5,099,226 | A | 3/1992 | Andrews |
| 5,101,200 | A | 3/1992 | Swett |
| 5,125,356 | A | 6/1992 | Galante |
| 5,197,140 | A | 3/1993 | Balmer |
| 5,198,647 | A | 3/1993 | Mizuta |
| 5,206,488 | A | 4/1993 | Teicher |
| 5,208,110 | A | 5/1993 | Smith et al. |
| 5,212,777 | A | 5/1993 | Gove et al. |
| 5,221,838 | A | 6/1993 | Gutman et al. |
| 5,222,282 | A | 6/1993 | Sukonnik et al. |
| 5,226,989 | A | 7/1993 | Sukonnik |
| 5,234,624 | A | 8/1993 | Bauer et al. |
| 5,239,654 | A | 8/1993 | IngSimmons et al. |
| 5,247,304 | A | 9/1993 | dHont |
| 5,257,656 | A | 11/1993 | McLeroy |
| 5,259,649 | A | 11/1993 | Shomron |
| 5,274,392 | A | 12/1993 | dHont et al. |
| 5,276,311 | A | 1/1994 | Hennige |
| 5,285,100 | A | 2/1994 | Byatt |
| 5,304,789 | A | 4/1994 | Lob et al. |
| 5,305,002 | A | 4/1994 | Holodak et al. |
| 5,308,121 | A | 5/1994 | Gunn |
| 5,326,964 | A | 7/1994 | Risser |
| 5,329,617 | A | 7/1994 | Asal |
| 5,331,138 | A | 7/1994 | Saroya |
| 5,339,447 | A | 8/1994 | Balmer |
| 5,349,357 | A | 9/1994 | Schurmann et al. |
| 5,351,052 | A | 9/1994 | dHont et al. |
| 5,359,522 | A | 10/1994 | Ryan |
| 5,371,896 | A | 12/1994 | Gove et al. |
| 5,373,303 | A | 12/1994 | dHont |
| 5,397,881 | A | 3/1995 | Mannik |
| 5,407,893 | A | 4/1995 | Koshizuka et al. |
| 5,408,243 | A | 4/1995 | dHont |
| 5,410,649 | A | 4/1995 | Gove |
| 5,412,192 | A | 5/1995 | Hoss |
| 5,428,363 | A | 6/1995 | dHont |
| 5,453,747 | A | 9/1995 | dHont et al. |
| 5,471,592 | A | 11/1995 | Gove et al. |
| 5,477,040 | A | 12/1995 | Lalonde |
| 5,485,510 | A | 1/1996 | Colbert |
| 5,488,376 | A | 1/1996 | Hurta et al. |
| 5,489,411 | A | 2/1996 | Jha et al. |
| 5,489,908 | A | 2/1996 | Orthmann et al. |
| 5,490,079 | A | 2/1996 | Sharpe et al. |
| 5,491,483 | A | 2/1996 | dHont |
| 5,491,484 | A | 2/1996 | Schuermann |
| 5,491,715 | A | 2/1996 | Flaxl |
| 5,493,312 | A | 2/1996 | Knebelkamp |
| 5,497,121 | A | 3/1996 | dHont |
| 5,500,651 | A | 3/1996 | Schuermann |
| 5,503,434 | A | 4/1996 | Gunn |
| 5,513,525 | A | 5/1996 | Schurmann |
| 5,519,381 | A | 5/1996 | Marsh et al. |
| 5,522,083 | A | 5/1996 | Gove et al. |
| 5,525,992 | A | 6/1996 | Froschermeier |
| 5,525,994 | A | 6/1996 | Hurta et al. |
| 5,528,222 | A | 6/1996 | Moskowitz et al. |
| 5,530,232 | A | 6/1996 | Taylor |
| 5,533,656 | A | 7/1996 | Bonaldi |
| 5,534,857 | A | 7/1996 | Laing et al. |
| 5,541,604 | A | 7/1996 | Meier |
| 5,543,798 | A | 8/1996 | Schuermann |
| 5,544,246 | A | 8/1996 | Mandelbaum et al. |
| 5,548,291 | A | 8/1996 | Meier et al. |
| 5,550,536 | A | 8/1996 | Flaxl |
| 5,550,548 | A | 8/1996 | Schuermann |
| 5,552,789 | A | 9/1996 | Schuermann |
| 5,555,877 | A | 9/1996 | Lockwood et al. |
| 5,557,279 | A | 9/1996 | dHont |
| 5,557,516 | A | 9/1996 | Hogan |
| 5,561,430 | A | 10/1996 | Knebelkamp |
| 5,563,582 | A | 10/1996 | dHont |
| 5,569,187 | A | 10/1996 | Kaiser |
| 5,569,897 | A | 10/1996 | Masuda |
| 5,572,226 | A | 11/1996 | Tuttle |
| 5,577,109 | A | 11/1996 | Stimson et al. |
| 5,578,808 | A | 11/1996 | Taylor |
| 5,581,630 | A | 12/1996 | Bonneau, Jr. |
| 5,585,787 | A | 12/1996 | Wallerstein |
| 5,590,038 | A | 12/1996 | Pitroda |
| 5,592,150 | A | 1/1997 | dHont |
| 5,592,405 | A | 1/1997 | Gove et al. |
| 5,592,767 | A | 1/1997 | Treske |
| 5,594,233 | A | 1/1997 | Kenneth et al. |
| 5,594,448 | A | 1/1997 | dHont |
| 5,597,534 | A | 1/1997 | Kaiser |
| 5,600,175 | A | 2/1997 | Orthmann |
| 5,602,538 | A | 2/1997 | Orthmann et al. |
| 5,602,919 | A | 2/1997 | Hurta et al. |
| 5,604,342 | A | 2/1997 | Fujioka |
| 5,606,520 | A | 2/1997 | Gove et al. |
| 5,606,594 | A | 2/1997 | Register et al. |
| 5,607,522 | A | 3/1997 | McDonnell |
| 5,608,406 | A | 3/1997 | Eberth et al. |
| 5,608,778 | A | 3/1997 | Partridge, III |
| 5,613,146 | A | 3/1997 | Gove et al. |
| 5,619,207 | A | 4/1997 | dHont |
| 5,621,396 | A | 4/1997 | Flaxl |
| 5,621,411 | A | 4/1997 | Hagl et al. |
| 5,621,412 | A | 4/1997 | Sharpe et al. |
| 5,625,366 | A | 4/1997 | dHont |
| 5,625,370 | A | 4/1997 | dHont |
| 5,625,695 | A | 4/1997 | MRaihi et al. |
| 5,629,981 | A | 5/1997 | Nerlikar |
| 5,638,080 | A | 6/1997 | Orthmann et al. |
| 5,640,002 | A | 6/1997 | Ruppert et al. |
| 5,646,607 | A | 7/1997 | Schurmann et al. |
| 5,649,118 | A | 7/1997 | Carlisle et al. |
| 5,657,388 | A | 8/1997 | Weiss |
| 5,660,319 | A | 8/1997 | Falcone et al. |
| 5,673,106 | A | 9/1997 | Thompson |
| 5,675,342 | A | 10/1997 | Sharpe |
| 5,686,920 | A | 11/1997 | Hurta et al. |
| 5,691,731 | A | 11/1997 | vanErven |
| 5,692,132 | A | 11/1997 | Hogan |
| 5,696,913 | A | 12/1997 | Gove et al. |

5,698,837 A 12/1997 Furuta
5,699,528 A 12/1997 Hogan
5,700,037 A 12/1997 Keller
5,701,127 A 12/1997 Sharpe
5,704,046 A 12/1997 Hogan
5,705,798 A 1/1998 Tarbox
5,710,421 A 1/1998 Kokubu
5,721,781 A 2/1998 Deo et al.
5,725,098 A 3/1998 Seifert et al.
5,729,053 A 3/1998 Orthmann
5,729,236 A 3/1998 Flaxl
5,731,957 A 3/1998 Brennan
5,732,579 A 3/1998 dHont et al.
5,748,137 A 5/1998 dHont
5,748,737 A 5/1998 Daggar
5,758,195 A 5/1998 Balmer
5,761,306 A 6/1998 Lewis
5,761,493 A 6/1998 Blakeley et al.
5,768,609 A 6/1998 Gove et al.
5,769,457 A 6/1998 Warther
5,773,812 A 6/1998 Kreft
5,774,882 A 6/1998 Keen et al.
5,777,903 A 7/1998 Piosenka et al.
5,778,067 A 7/1998 Jones et al.
5,785,680 A 7/1998 Niezink et al.
5,789,733 A 8/1998 Jachimowicz et al.
5,792,337 A 8/1998 Padovani et al.
5,793,324 A 8/1998 Aslanidis et al.
5,794,095 A 8/1998 Thompson
5,797,060 A 8/1998 Thompson
5,797,085 A 8/1998 Beuk et al.
5,797,133 A 8/1998 Jones et al.
5,798,709 A 8/1998 Flaxl
5,809,142 A 9/1998 Hurta et al.
5,809,288 A 9/1998 Balmer
5,809,633 A 9/1998 Mundigl et al.
5,825,007 A 10/1998 Jesadanont
5,825,302 A 10/1998 Stafford
5,826,077 A 10/1998 Blakeley et al.
5,826,243 A 10/1998 Musmanno et al.
5,828,044 A 10/1998 Jun et al.
5,834,756 A 11/1998 Gutman et al.
5,838,257 A 11/1998 Lambropoulos
5,838,720 A 11/1998 Morelli
5,841,364 A 11/1998 Hagl et al.
5,842,088 A 11/1998 Thompson
5,844,218 A 12/1998 Kawan et al.
5,844,230 A 12/1998 Lalonde
5,845,267 A 12/1998 Ronen
5,851,149 A 12/1998 Xidos et al.
5,854,891 A 12/1998 Postlewaite et al.
5,857,152 A 1/1999 Everett
5,858,006 A 1/1999 Van der AA et al.
5,859,419 A 1/1999 Wynn
5,859,587 A * 1/1999 Alicot et al. ..... 340/572.8
5,859,779 A 1/1999 Giordano et al.
5,864,306 A 1/1999 Dwyer et al.
5,864,323 A 1/1999 Berthon
5,867,100 A 2/1999 dHont
5,870,031 A 2/1999 Kaiser et al.
5,870,915 A 2/1999 dHont
5,878,215 A 3/1999 Kling et al.
5,878,337 A 3/1999 Joao et al.
5,878,403 A 3/1999 DeFrancesco et al.
5,880,675 A 3/1999 Trautner
5,881,272 A 3/1999 Balmer
5,883,377 A 3/1999 Chapin, Jr.
5,887,266 A 3/1999 Heinonen et al.
5,890,137 A 3/1999 Koreeda
5,898,783 A 4/1999 Rohrbach
5,903,830 A 5/1999 Joao et al.
5,905,798 A 5/1999 Nerlikar et al.
5,912,678 A 6/1999 Saxena et al.
5,917,168 A 6/1999 Nakamura et al.
5,920,628 A 7/1999 Indeck et al.
5,923,734 A 7/1999 Taskett
5,923,884 A 7/1999 Peyret et al.
5,924,080 A 7/1999 Johnson
5,929,801 A 7/1999 Aslanidis et al.
5,931,917 A 8/1999 Nguyen et al.
5,933,624 A 8/1999 Balmer
5,943,624 A 8/1999 Fox et al.
5,948,116 A 9/1999 Aslanidis et al.
5,950,179 A 9/1999 Buchanan
5,953,512 A 9/1999 Cai et al.
5,955,717 A 9/1999 Vanstone
5,955,951 A 9/1999 Wischerop et al.
5,955,969 A 9/1999 dHont
5,956,024 A 9/1999 Strickland et al.
5,963,924 A 10/1999 Williams et al.
5,969,318 A 10/1999 Mackenthun
5,970,148 A 10/1999 Meier
5,974,238 A 10/1999 Chase, Jr.
RE36,365 E 11/1999 Levine et al.
5,978,840 A 11/1999 Nguyen et al.
5,982,293 A 11/1999 Everett et al.
5,983,208 A 11/1999 Haller
5,987,140 A 11/1999 Rowney et al.
5,987,155 A 11/1999 Dunn et al.
5,987,498 A 11/1999 Athing et al.
5,988,510 A 11/1999 Tuttle
5,989,950 A 11/1999 Wu
5,991,608 A 11/1999 Leyten
5,991,748 A 11/1999 Taskett
5,991,750 A 11/1999 Watson
5,996,076 A 11/1999 Rowney et al.
6,002,438 A 12/1999 Hocevar et al.
6,002,767 A 12/1999 Kramer
6,003,014 A 12/1999 Lee et al.
6,005,942 A 12/1999 Chan et al.
6,006,216 A 12/1999 Griffin et al.
6,012,049 A 1/2000 Kawan
6,012,636 A 1/2000 Smith
6,014,645 A 1/2000 Cunningham
6,016,476 A 1/2000 Maes et al.
6,018,717 A 1/2000 Lee et al.
6,024,286 A 2/2000 Bradley et al.
6,029,149 A 2/2000 Dykstra et al.
6,029,892 A 2/2000 Miyake
6,032,136 A 2/2000 Brake, Jr. et al.
6,036,100 A 3/2000 Asami
6,038,292 A 3/2000 Thomas
6,038,584 A 3/2000 Balmer
6,047,888 A 4/2000 Dethloff
6,050,494 A 4/2000 Song et al.
6,052,675 A 4/2000 Checchio
6,064,320 A 5/2000 dHont et al.
6,068,184 A 5/2000 Barnett
6,068,193 A 5/2000 Kreft
6,070,003 A 5/2000 Gove et al.
6,072,870 A 6/2000 Nguyen et al.
6,073,840 A 6/2000 Marion
6,076,296 A 6/2000 Schaeffer
6,078,888 A 6/2000 Johnson, Jr.
RE36,788 E 7/2000 Mansvelt et al.
6,085,976 A 7/2000 Sehr
6,088,686 A 7/2000 Walker et al.
6,089,611 A 7/2000 Blank
6,092,057 A 7/2000 Zimmerman et al.
6,095,567 A 8/2000 Buell
6,098,879 A 8/2000 Terranova
6,099,043 A 8/2000 Story
6,100,804 A * 8/2000 Brady et al. ..... 340/572.7
6,101,174 A 8/2000 Langston
6,102,162 A 8/2000 Teicher
6,102,672 A 8/2000 Woollenweber et al.

6,105,008 A 8/2000 Davis et al.
6,105,013 A 8/2000 Curry et al.
6,105,865 A 8/2000 Hardesty
6,107,920 A 8/2000 Eberhardt et al.
6,108,641 A 8/2000 Kenna et al.
6,109,525 A 8/2000 Blomqvist et al.
6,112,152 A 8/2000 Tuttle
6,115,360 A 9/2000 Quay et al.
6,116,423 A 9/2000 Troxtell, Jr. et al.
6,116,505 A 9/2000 Withrow
6,118,189 A 9/2000 Flaxl
6,121,544 A 9/2000 Petsinger
6,123,223 A 9/2000 Watkins
6,129,274 A 10/2000 Suzuki
6,130,623 A 10/2000 MacLellan et al.
6,133,834 A 10/2000 Eberth et al.
6,138,913 A 10/2000 Cyr et al.
6,138,917 A 10/2000 Chapin, Jr.
6,141,651 A 10/2000 Riley et al.
6,144,916 A 11/2000 Wood et al.
6,144,948 A 11/2000 Walker et al.
6,157,824 A 12/2000 Bailey
6,163,771 A 12/2000 Walker et al.
6,167,236 A 12/2000 Kaiser et al.
6,168,083 B1 1/2001 Berger et al.
6,173,897 B1 1/2001 Halpern
6,173,898 B1 1/2001 Mande
6,173,899 B1 1/2001 Rozin
6,177,859 B1 1/2001 Tuttle et al.
6,177,860 B1 1/2001 Cromer et al.
6,179,205 B1 1/2001 Sloan
6,179,206 B1 1/2001 Matsumori
6,185,307 B1 2/2001 Johnson, Jr.
6,188,994 B1 2/2001 Egendorf
6,189,787 B1 2/2001 Dorf
6,192,255 B1 2/2001 Lewis et al.
6,195,006 B1 2/2001 Bowers et al.
6,198,728 B1 3/2001 Hulyalkar et al.
6,198,875 B1 3/2001 Edenson et al.
6,202,927 B1 3/2001 Bashan et al.
6,205,151 B1 3/2001 Quay et al.
6,206,293 B1 3/2001 Gutman et al.
6,213,390 B1 4/2001 Oneda
6,213,391 B1 4/2001 Lewis
6,215,437 B1 4/2001 Schurmann et al.
6,216,219 B1 4/2001 Cai et al.
6,219,439 B1 4/2001 Burger
6,220,510 B1 4/2001 Everett et al.
D442,627 S 5/2001 Webb et al.
D442,629 S 5/2001 Webb et al.
6,223,984 B1 5/2001 Renner et al.
6,224,109 B1 5/2001 Yang
6,226,382 B1 5/2001 MRaihi et al.
6,230,270 B1 5/2001 Laczko, Sr.
6,232,917 B1 5/2001 Baumer et al.
6,233,683 B1 5/2001 Chan et al.
6,237,848 B1 5/2001 Everett
6,239,675 B1 5/2001 Flaxl
6,240,187 B1 5/2001 Lewis
6,240,989 B1 6/2001 Masoud
6,250,554 B1 6/2001 Leo et al.
6,250,557 B1 6/2001 Forslund et al.
6,257,486 B1 7/2001 Teicher et al.
6,259,769 B1 7/2001 Page et al.
6,260,026 B1 7/2001 Tomida et al.
6,260,088 B1 7/2001 Gove et al.
6,263,316 B1 7/2001 Khan et al.
6,264,106 B1 7/2001 Bridgelall
6,266,754 B1 7/2001 Laczko, Sr. et al.
6,273,335 B1 8/2001 Sloan
6,282,522 B1 8/2001 Davis et al.
D447,515 S 9/2001 Faenza, Jr. et al.
6,286,763 B1 9/2001 Reynolds et al.
6,289,324 B1 9/2001 Kawan
6,290,137 B1 9/2001 Kiekhaefer
6,293,462 B1 9/2001 Gangi
6,297,727 B1 10/2001 Nelson, Jr.
6,304,223 B1 10/2001 Hilton et al.
6,309,098 B1 10/2001 Wong
6,315,193 B1 11/2001 Hogan
6,315,195 B1 11/2001 Ramachandran
6,317,721 B1 11/2001 Hurta et al.
6,318,636 B1 11/2001 Reynolds et al.
6,323,566 B1 11/2001 Meier
6,325,285 B1 12/2001 Baratelli
6,325,293 B1 12/2001 Moreno
6,326,934 B1 12/2001 Kinzie
6,327,573 B1 12/2001 Walker et al.
6,331,972 B1 12/2001 Harris et al.
6,339,384 B1 1/2002 Valdes-Rodriguez
6,342,844 B1 1/2002 Rozin
6,353,420 B1 3/2002 Chung
6,353,811 B1 3/2002 Weissman
6,364,208 B1 4/2002 Stanford et al.
6,367,011 B1 4/2002 Lee et al.
6,374,245 B1 4/2002 Park
6,377,034 B1 4/2002 Ivanov
6,386,444 B1 5/2002 Sullivan
6,388,533 B2 5/2002 Swoboda
6,390,375 B2 5/2002 Kayanakis
6,400,272 B1 6/2002 Holtzman et al.
6,402,026 B1 6/2002 Schwier
6,402,028 B1 6/2002 Graham, Jr. et al.
6,404,341 B1 * 6/2002 Reid ..... 340/572.8
6,406,935 B2 6/2002 Kayanakis et al.
6,411,611 B1 6/2002 Van der Tuijn
6,415,978 B1 7/2002 McAllister
6,421,650 B1 7/2002 Goetz et al.
6,422,464 B1 7/2002 Terranova
6,422,472 B1 7/2002 Thevenot et al.
6,424,029 B1 7/2002 Giesler
RE37,822 E 8/2002 Anthonyson
6,427,910 B1 8/2002 Barnes et al.
6,435,415 B1 8/2002 Catte
6,439,455 B1 8/2002 Everett et al.
6,442,532 B1 8/2002 Kawan
6,457,996 B1 10/2002 Shih
6,466,804 B1 10/2002 Pecen et al.
6,471,127 B2 10/2002 Pentz et al.
6,473,500 B1 10/2002 Risafi et al.
6,480,100 B1 11/2002 Frieden et al.
6,480,101 B1 11/2002 Kelly et al.
6,481,621 B1 11/2002 Herrendoerfer et al.
6,481,632 B2 11/2002 Wentker et al.
6,484,937 B1 11/2002 Devaux et al.
6,490,443 B1 12/2002 Freeny, Jr.
6,491,229 B1 12/2002 Berney
6,494,367 B1 12/2002 Zacharias
6,494,380 B2 12/2002 Jarosz
6,505,772 B1 1/2003 Mollett et al.
6,507,762 B1 1/2003 Amro et al.
6,510,983 B2 1/2003 Horowitz et al.
6,510,998 B1 1/2003 Stanford et al.
6,513,015 B2 1/2003 Ogasawara
6,529,880 B1 3/2003 McKeen et al.
6,535,726 B1 3/2003 Johnson
6,546,373 B1 4/2003 Cerra
6,547,133 B1 4/2003 DeVries, Jr. et al.
6,549,912 B1 4/2003 Chen
6,560,581 B1 5/2003 Fox et al.
6,577,229 B1 6/2003 Bonneau et al.
6,578,768 B1 6/2003 Binder et al.
6,581,839 B1 6/2003 Lasch et al.
6,588,660 B1 7/2003 Buescher et al.
6,589,119 B1 7/2003 Orus et al.
6,608,995 B1 8/2003 Kawasaki et al.

6,609,655 B1 8/2003 Harrell
6,626,356 B2 9/2003 Davenport et al.
6,628,961 B1 9/2003 Ho et al.
6,631,849 B2 10/2003 Blossom
6,636,833 B1 10/2003 Flitcroft et al.
6,650,887 B2 11/2003 McGregor et al.
6,665,405 B1 12/2003 Lenstra
6,674,786 B1 1/2004 Nakamura et al.
6,679,427 B1 1/2004 Kuroiwa
6,681,328 B1 1/2004 Harris et al.
6,684,269 B2 1/2004 Wagner
6,685,089 B2 2/2004 Terranova et al.
6,686,847 B1 2/2004 Mittler
6,687,714 B1 2/2004 Kogen et al.
6,690,930 B1 2/2004 Dupre
6,693,513 B2 2/2004 Tuttle
6,705,530 B2 3/2004 Kiekhaefer
6,708,375 B1 3/2004 Johnson
6,711,262 B1 3/2004 Watanen
6,732,919 B2 5/2004 Macklin et al.
6,732,936 B1 5/2004 Kiekhaefer
6,742,120 B1 5/2004 Markakis et al.
6,760,581 B2 7/2004 Dutta
6,789,012 B1 9/2004 Childs et al.
6,789,733 B2 9/2004 Terranova et al.
6,793,141 B1 9/2004 Graham
6,830,193 B2 12/2004 Tanaka
6,853,894 B1 2/2005 Kolls
6,857,566 B2 2/2005 Wankmueller
6,859,672 B2 2/2005 Roberts et al.
6,895,310 B1 5/2005 Kolls
6,915,277 B1 7/2005 Manchester et al.
6,924,729 B1 8/2005 Aschauer et al.
D509,243 S 9/2005 Hunter, Jr. et al.
6,978,933 B2 12/2005 Yap et al.
7,004,385 B1 2/2006 Douglass
7,069,444 B2 6/2006 Lowensohn et al.
7,093,767 B2 8/2006 Faenza et al.
7,239,226 B2 * 7/2007 Berardi et al. ..... 340/5.61
2001/0013542 A1 8/2001 Horowitz et al.
2001/0024157 A1 9/2001 Hansmann et al.
2001/0030238 A1 10/2001 Arisawa
2001/0034565 A1 10/2001 Leatherman
2001/0039617 A1 11/2001 Buhrlen et al.
2002/0011519 A1 1/2002 Shults
2002/0019807 A1 2/2002 Halpern
2002/0028704 A1 3/2002 Bloomfield et al.
2002/0035548 A1 3/2002 Hogan et al.
2002/0040935 A1 4/2002 Weyant
2002/0040936 A1 4/2002 Wentker et al.
2002/0052839 A1 5/2002 Takatori
2002/0062284 A1 5/2002 Kawan
2002/0074398 A1 6/2002 Lancos et al.
2002/0077837 A1 6/2002 Krueger et al.
2002/0077895 A1 6/2002 Howell
2002/0077992 A1 6/2002 Tobin
2002/0079367 A1 6/2002 Montani
2002/0092914 A1 7/2002 Pentz et al.
2002/0095343 A1 7/2002 Barton et al.
2002/0095389 A1 7/2002 Gaines
2002/0095587 A1 7/2002 Doyle et al.
2002/0097144 A1 7/2002 Collins et al.
2002/0107007 A1 8/2002 Gerson
2002/0107742 A1 8/2002 Magill
2002/0109580 A1 8/2002 Shreve et al.
2002/0111210 A1 8/2002 Luciano, Jr. et al.
2002/0113082 A1 8/2002 Leatherman et al.
2002/0116274 A1 8/2002 Hind et al.
2002/0120584 A1 8/2002 Hogan et al.
2002/0126010 A1 9/2002 Trimble et al.
2002/0131567 A1 9/2002 Maginas
2002/0138438 A1 9/2002 Bardwell
2002/0140542 A1 10/2002 Prokoski et al.
2002/0145043 A1 10/2002 Challa et al.
2002/0147913 A1 10/2002 Lun
2002/0148892 A1 10/2002 Bardwell
2002/0152123 A1 10/2002 Giordano et al.
2002/0166891 A1 11/2002 Stoutenburg et al.
2002/0176522 A1 11/2002 Fan
2002/0178063 A1 11/2002 Gravelle et al.
2002/0178369 A1 11/2002 Black
2002/0185543 A1 12/2002 Pentz et al.
2002/0188501 A1 12/2002 Lefkowith
2002/0190125 A1 12/2002 Stockhammer
2002/0192856 A1 12/2002 Halope et al.
2002/0193102 A1 12/2002 Hyyppa et al.
2002/0194303 A1 12/2002 Suila et al.
2002/0194503 A1 12/2002 Faith et al.
2002/0196963 A1 12/2002 Bardwell
2003/0009382 A1 1/2003 DArbelott et al.
2003/0014307 A1 1/2003 Heng
2003/0014357 A1 1/2003 Chrisekos et al.
2003/0014891 A1 1/2003 Nelms et al.
2003/0018532 A1 1/2003 Dudek et al.
2003/0025600 A1 2/2003 Blanchard
2003/0028481 A1 2/2003 Flitcroft et al.
2003/0033697 A1 2/2003 Hicks et al.
2003/0037851 A1 2/2003 Hogganivk
2003/0046228 A1 3/2003 Michot
2003/0057226 A1 3/2003 Long
2003/0057278 A1 3/2003 Wong
2003/0069828 A1 4/2003 Blazey et al.
2003/0069846 A1 4/2003 Marcon
2003/0112972 A1 6/2003 Hattick et al.
2003/0120554 A1 6/2003 Hogan et al.
2003/0121969 A1 7/2003 Wankmueller
2003/0132284 A1 7/2003 Reynolds et al.
2003/0140228 A1 7/2003 Binder
2003/0160074 A1 8/2003 Pineda
2003/0163699 A1 8/2003 Pailles et al.
2003/0167207 A1 9/2003 Berardi et al.
2003/0177347 A1 9/2003 Schneier et al.
2003/0183689 A1 10/2003 Swift et al.
2003/0183695 A1 10/2003 Labrec et al.
2003/0183699 A1 10/2003 Masui
2003/0187786 A1 10/2003 Swift et al.
2003/0187787 A1 10/2003 Freund
2003/0187790 A1 10/2003 Swift et al.
2003/0187796 A1 10/2003 Swift et al.
2003/0195842 A1 10/2003 Reece
2003/0195843 A1 10/2003 Matsuda et al.
2003/0200184 A1 10/2003 Dominguez et al.
2003/0218066 A1 11/2003 Fernandes et al.
2003/0220876 A1 11/2003 Burger et al.
2003/0222153 A1 12/2003 Pentz et al.
2003/0225623 A1 12/2003 Wankmueller
2003/0225713 A1 12/2003 Atkinson et al.
2003/0227550 A1 12/2003 Manico et al.
2003/0230514 A1 12/2003 Baker
2003/0233334 A1 12/2003 Smith
2004/0010462 A1 1/2004 Moon et al.
2004/0011877 A1 1/2004 Reppermund
2004/0015451 A1 1/2004 Sahota et al.
2004/0016796 A1 1/2004 Hanna et al.
2004/0026518 A1 2/2004 Kudo et al.
2004/0029569 A1 2/2004 Khan et al.
2004/0039860 A1 2/2004 Mills et al.
2004/0046034 A1 3/2004 Yamani et al.
2004/0127256 A1 7/2004 Goldthwaite et al.
2004/0139021 A1 7/2004 Reed et al.
2004/0176071 A1 9/2004 Gehrmann et al.
2004/0177045 A1 9/2004 Brown
2004/0180657 A1 9/2004 Yaqub et al.
2004/0235450 A1 11/2004 Rosenburg
2005/0004921 A1 1/2005 Beenau et al.
2005/0023157 A1 2/2005 Logan

| | | | |
|---|---|---|---|
| 2005/0033686 | A1 | 2/2005 | Peart et al. |
| 2005/0035847 | A1 | 2/2005 | Bonalle et al. |
| 2005/0038718 | A1 | 2/2005 | Barnes et al. |
| 2005/0040272 | A1 | 2/2005 | Argumedo et al. |
| 2005/0045718 | A1 | 3/2005 | Bortolin et al. |
| 2005/0113137 | A1 | 5/2005 | Rodriguez et al. |
| 2005/0121512 | A1 | 6/2005 | Wankmueller |
| 2005/0122209 | A1 | 6/2005 | Black |
| 2005/0127164 | A1 | 6/2005 | Wankmueller |
| 2005/0171905 | A1 | 8/2005 | Wankmueller |
| 2005/0221853 | A1 | 10/2005 | Silvester |

FOREIGN PATENT DOCUMENTS

| | | | |
|---|---|---|---|
| DE | 2847756 | | 5/1980 |
| DE | 29702538 | | 4/1997 |
| EP | 0181770 | | 5/1986 |
| EP | 0343829 | A2 | 11/1989 |
| EP | 0354817 | B1 | 2/1990 |
| EP | 0368570 | A2 | 5/1990 |
| EP | 0388090 | | 9/1990 |
| EP | 0403134 | | 12/1990 |
| EP | 0411602 | | 2/1991 |
| EP | 0473998 | A2 | 3/1992 |
| EP | 0481388 | B1 | 4/1992 |
| EP | 0531605 | B1 | 3/1993 |
| EP | 0552047 | B1 | 7/1993 |
| EP | 0560318 | B1 | 9/1993 |
| EP | 0568185 | B1 | 11/1993 |
| EP | 0657297 | B1 | 6/1995 |
| EP | 0721850 | A2 | 7/1996 |
| EP | 0780839 | A2 | 6/1997 |
| EP | 0789316 | B1 | 8/1997 |
| EP | 0894620 | A1 | 2/1999 |
| EP | 0916519 | | 5/1999 |
| GB | 1371254 | | 10/1974 |
| GB | 2108906 | | 5/1985 |
| GB | 2240948 | | 8/1991 |
| JP | 62-043774 | | 3/1987 |
| JP | 62-264999 | | 11/1987 |
| JP | 63-071794 | | 4/1988 |
| JP | 63-098689 | | 4/1988 |
| JP | 63-72721 | | 5/1988 |
| JP | 63-175987 | | 7/1988 |
| JP | 64-004934 | | 1/1989 |
| JP | 64-087395 | | 3/1989 |
| JP | 64-087396 | | 3/1989 |
| JP | 64-087397 | | 3/1989 |
| JP | 02-130737 | | 5/1990 |
| JP | 02-252149 | | 10/1990 |
| JP | 03-290780 | | 12/1991 |
| JP | 04-303692 | | 10/1992 |
| JP | 05/069689 | | 3/1993 |
| JP | 05-254283 | | 10/1993 |
| JP | 06-183187 | | 7/1994 |
| JP | 06-191137 | | 7/1994 |
| JP | 06/234287 | | 8/1994 |
| JP | 07-173358 | | 7/1995 |
| JP | 07-205569 | | 8/1995 |
| JP | 08-244385 | | 9/1996 |
| JP | 08-324163 | | 12/1996 |
| JP | 09-052240 | | 2/1997 |
| JP | 09-274640 | | 10/1997 |
| JP | 10-129161 | | 5/1998 |
| JP | 0866420 | A2 | 9/1998 |
| JP | 11-227367 | | 8/1999 |
| JP | 2000-177229 | | 6/2000 |
| JP | 2001-504406 | | 4/2001 |
| JP | 2001-315475 | | 11/2001 |
| JP | 2002-274087 | | 9/2002 |
| WO | WO 81/00776 | | 3/1981 |
| WO | WO 89/03760 | | 5/1989 |
| WO | WO 90/08661 | | 8/1990 |
| WO | WO 92/16913 | | 10/1992 |
| WO | WO 96/189732 | | 6/1996 |
| WO | WO 99/12136 | | 3/1999 |
| WO | WO 99/14055 | | 3/1999 |
| WO | WO 99/27492 | | 6/1999 |
| WO | WO 99/47983 | | 9/1999 |
| WO | WO 01/55955 | | 8/2001 |

OTHER PUBLICATIONS http://www.palowireless.com/infotooth/whatis.asp. Apr. 28, 2003.
http://www.palowireless.com/infotooth/tutorial.asp, Apr. 28, 2003.
http://www.palowireless.com/infotooth/tutorial/profiles.asp, Apr. 28, 2003.
http://www.palowireless.com/infotooth/tutorial/radio.asp, Apr. 28, 2003.
http://www.polowireless.com/infotooth/tutorial/baseband.asp, Apr. 28, 2003.
http://www.palowireless.com/infotooth/tutorial/lmp.asp, Apr. 28, 2003.
http://www.palowireless.com/infotooth/tutorial/hci.asp, Apr. 28, 2003.
http://www.palowireless.com/infotooth/tutorial/12cap.asp, Apr. 28, 2003.
http://www.palowireless.com.infotooth/tutorial/rfcomm.asp, Apr. 28, 2003.
http://www.palowireless.com/infotooth/tutorial/sdp.asp, Apr. 28, 2003.
http://www.palowireless.com/infotooth/tutorialk1_gap.asp, Apr. 28, 2003.
"Sony, Phillips to Test RFID Platform", RFID Journal, May 8, 2003.
USBanker, Article 5, 1995, http://www.banking.com/us-banker/art5.

* cited by examiner

SYSTEM AND METHOD FOR PROVIDING AND RFID TRANSACTION DEVICE

CROSS-REFERENCE TO RELATED APPLICATIONS

This application is a continuation-in-part of, and claims priority to, U.S. application Ser. No. 10/746,781, entitled "A SYSTEM AND METHOD FOR MAN FACT RING A PUNCH-OUT RFID TRANSACTION DEVICE," filed Dec. 24, 2003. This application is also a continuation-in-part of, and claims priority to, U.S. patent application Ser. No. 10/192,488, entitled "SYSTEM AND METHOD FOR PAYMENTUSING RADIO FREQUENCY IDENTIFICATION IN CONTACT AND CONTACTLESS TRANSACTIONS," filed Jul. 9, 2002 (which itself claims priority to U.S. Provisional Patent Application No. 60/304,216, filed Jul. 10, 2001). The application is also a continuation-in-part of and claims priority, to U.S. patent application Ser. No. 10/340,352, entitled "SYSTEM AND METHOD FOR INCENTING PAYMENTUSING RADIO FREQUENCY IDENTIFICATION IN CONTACT AND CONTACTLESS TRANSACTIONS," filed Jan. 10, 2003 (which itself claims priority to U.S. Provisional Patent Application No. 60/396,577, filed Jul. 16, 2002). The entire contents of each of these applications is hereby incorporated by reference.

FIELD OF INVENTION

The present invention generally relates to transaction devices, and more particularly, to a system and method for permanently or temporarily affixing a Radio Frequency operable transaction device to any article.

BACKGROUND OF INVENTION

Like barcode and voice data entry, Radio Frequency identification ("RFID") is a contactless information acquisition technology. RFID systems are wireless, and are usually extremely effective in hostile environments where conventional acquisition methods fail.

Companies that provide consumers with transaction accounts are looking for ways to permit RFID transaction completion. Because of its diminutive size, RFID technology may be incorporated in transaction devices that are dimensionally smaller than traditional smartcards or credit cards and the like. RFID technology, therefore, is better suited for securing against loss or theft. For example, companies have embodied the RFID technology in form factors that consumers are accustomed to keeping track of, such as a key chain, fob or tag. The key chain fob may be easily secured because of its diminutive size and because it is frequently handled by consumers as compared to traditional smart cards and transaction cards.

RFID transaction devices have the additional advantage of being more convenient to present for transaction completion than traditional transaction cards. For example, when using an RFID transaction device attached to a fob, the consumer need only present the RFID transaction device in proximity to an RFID reader instead of surrendering physical control of the transaction device which must be done with traditional credit cards and smartcards.

By providing an RFID transaction device (e.g., fob) as described above, transaction account providers are able to attract account consumers in increasing numbers. The account consumers often prefer account providers which offer the RFID transaction device option because of the convenience of use and the increased security using an RF transaction fob provides. As such, because of the increased popularity and benefits associated with RFID transaction devices, many banking and financing institutions, department stores, petroleum companies and other organizations have developed their own RFID transaction devices for use by the organization's consumers.

Key chain or fob form factors have a major drawback in that the form factors are still susceptible to being lost or misplaced by the fob owner. Additionally, the key chain or fob form factors are sometimes inconvenient in that the consumer must still handle the form factor to present it for transaction completion.

SUMMARY OF INVENTION

The present invention relates to a system and method for securing RFID transaction device and methods of using the same. Specifically, the system includes an RFID transaction device that may be secured to a consumer's person enabling transaction completion without the need for the consumer to manually present the transaction device.

An RFID transaction device is attachable to an article worn or carried by the consumer. In an exemplary embodiment, the RFID transaction device includes an RFID module for sending transaction account information in response to an interrogation signal provided by an RFID reader. The RFID module may be secured in an RFID module carrier housing that has an attachment apparatus for attaching the carrier housing to an article, such as a consumer's apparel, clothing, or an article transported by the consumer. In one embodiment, the attachment apparatus may be an adhesive pad affixed to the RFID module carrier housing for adhering the carrier housing to the article. The adhesive pad may include a glue or Velcro®, or the like, useful for permanently or temporarily affixing the carrier housing to a cloth, leather, or other textile surface.

In another exemplary embodiment, the attachment apparatus is an elastic band affixed to the RFID module carrier housing that is used to attach the carrier housing to a consumer's person, clothing, or any article carried by the consumer. The elastic band includes a first band end affixed to the carrier housing and the second band end affixed to a second opposing end of the carrier housing such that the band forms a loop including the carrier housing. Since the band is elastic the size of the loop may be adjusted by placing tension on the band to enlarge the loop permitting the consumer to insert an article between the elastic band and the carrier housing. Once the tension on the band is relaxed, the band surrounds and grips the article, affixing the carrier housing to the consumer, or to an article worn or carried by the consumer.

In yet another exemplary embodiment, the attachment apparatus includes an attachment apparatus housing having a torsion spring attached to a band for retracting a portion of the band into the attachment housing. The band is attached to the spring at a first band end and attached to the carrier housing at a second opposing band end so that a loop is formed between the band and the carrier housing. The size of the loop is adjusted by applying a force to the first band end attached to the torsion spring to remove a portion of the band from the attachment housing. The carrier housing is attached to an article by inserting the article in the loop and permitting the spring to place a force on the band to retract the band into the carrier housing, thereby reducing the size of the loop to constrict over the article.

In still another embodiment, the attachment apparatus includes a first string attached to a first end of the carrier housing and a second string attached to a second opposing end of the carrier housing. The first and second strings may be placed in proximity one to the other near the distal ends of the strings using a slideable string fastener, such that the first and second strings form a loop between the fastener and the carrier housing. The string fastener is operable to adjust the size of the loop for inserting an article in the loop between the fastener and the carrier housing. The carrier housing is affixed to the consumer, or to an article carried or worn by the consumer by sliding the fastener along the first and second string in proximity to the article, the fastener thereby promoting the constricting action of the loop around the article.

In still another embodiment, the attachment apparatus is a single continuous string where the first end of the string is attached to a first portion of the RFID module carrier housing and the second end of the string is attached to a second opposing portion of the RFID module carrier housing, such that the string forms a loop including the carrier housing. The continuous string is pinched along the loop by a string fastener forming a first smaller loop away from the carrier housing between the fastener and the carrier housing and a second larger loop. The string fastener is slideable for adjusting the size of the larger loop. The fastener is slid along the string and nearer to the carrier housing, thereby reducing the circumference of the larger loop permitting the loop to be constricted around an article. The constricting action secures the housing to a consumer, consumer's clothing, or to an apparatus carried by the consumer, as before.

Finally, another embodiment of the attachment apparatus includes a spring biased clamp affixed to the carrier housing. The spring biased clamp includes opposing jaws that are opened to permit an article worn or carried by the consumer to be inserted therein. The opposing jaws are permitted to close so that the clamp grips the article securing the carrier housing thereto.

The RFID module uses RFID technology to initiate and complete financial transactions. In that regard, the module includes an RF transponder, processor and antenna ("RFID components") in the module body. The RFID components are typically included during the RFID module fabrication. The RFID module is a passive module, in that it transmits transaction account information when interrogated by an interrogation signal. That is, the interrogation signal operates to power the RFID components for transaction completion. Thus, the system in which an RFID transaction device, including the RFID module, is used includes an RFID reader operable to provide the interrogation signal for powering the RFID components, receiving an RF signal from the RFID module that includes RFID module identifying information, and providing the RFID module identifying information to a point-of-interaction device for transaction completion. The RFID reader is configured to send a standing interrogation signal that may be continuously or intermittently transmitted from the RFID reader via radio frequency (or electromagnetic) propagation. In an exemplary operation, the RFID module is placed within proximity to the RFID reader such that the interrogation signal interrogates the RFID module for transaction completion.

Additional features and advantages of the present invention are described in, and will be apparent from, the detailed description of the present exemplary embodiments and from the drawings.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

DETAILED DESCRIPTION

The present invention includes a system and method for securing an RFID transaction device to an article. The RFID transaction device in accordance with this invention is operable to complete a transaction in a contactless environment using RFID technology. An exemplary transaction device useful with the invention includes a conventional RFID operable transponder system capable of receiving an interrogation signal and providing RFID transponder system identifying data for transaction completion. As used herein, the circuitry supporting the RFID operation of the transaction is called "RFID module" for consistency.

Figure 1:
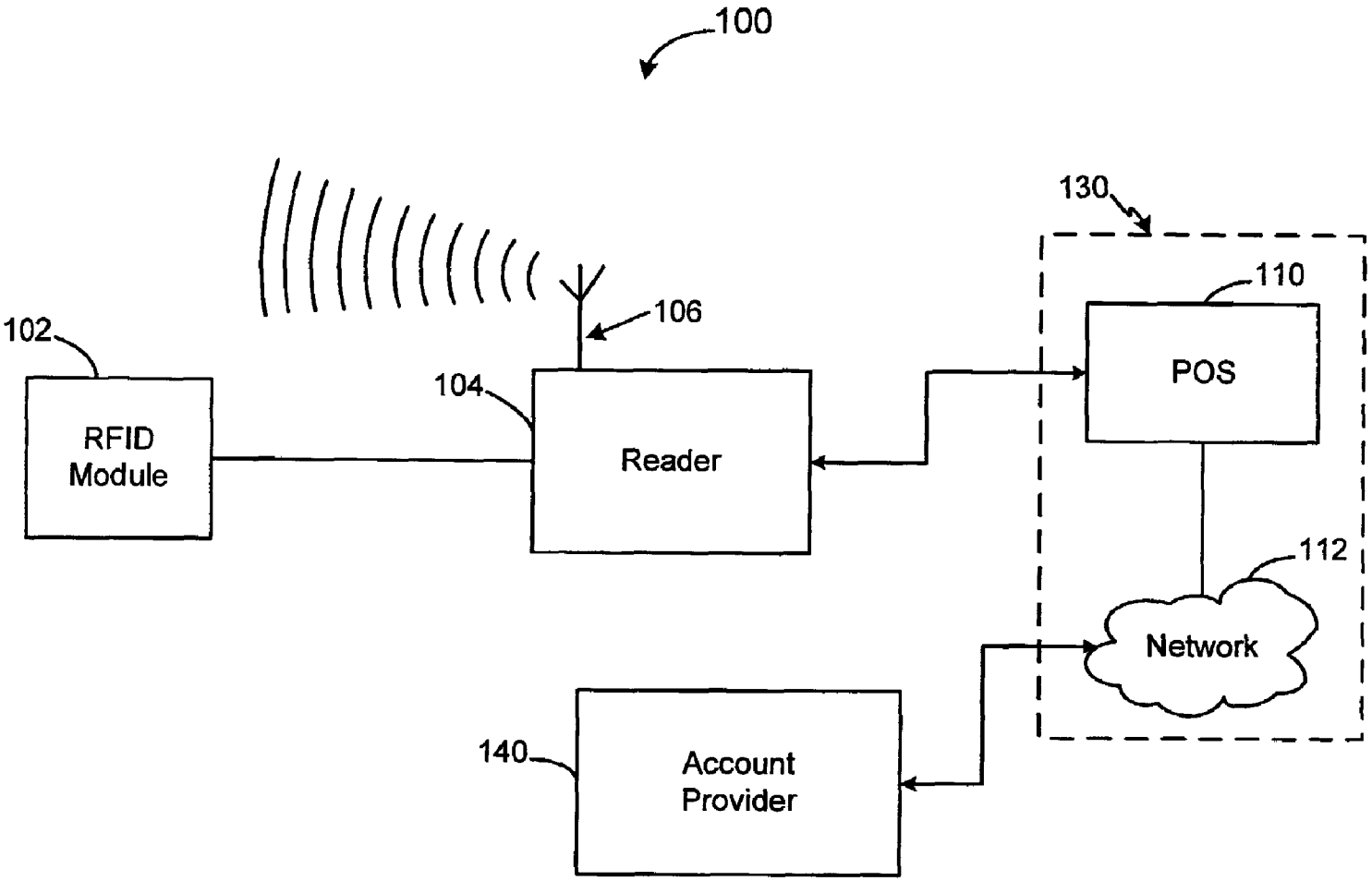
FIG. 1 illustrates an exemplary RFID transaction completion system in accordance with an exemplary embodiment of the present invention.

FIG. 1 illustrates an exemplary RFID transaction completion system 100 wherein exemplary components for RFID transaction completion are depicted. System 100 includes an RFID module 102 in RF communication with an RFID reader 104 via an antenna 106. RFID reader 104 is in communication with a merchant system 130 via point-of-sale device 110. Merchant system 130 is in communication with an RFID transaction account provider 140, via a network 112.

In general, the operation of system 100 may begin when RFID module 102 is presented for transaction completion. The transaction proceeds when RFID reader 104 provides an interrogation signal for powering RFID module 102, thereby providing the necessary power for activating the RFID components. Once RFID module 102 is activated, module 102 provides a transponder identifier and/or account identifier to RFID reader 104. RFID reader 104 then provides the identifier to merchant system 130 for transaction completion. More particularly, RFID reader 104 provides the identifier to POS device 110, which provides the identifier to account provider 140 via network 112 for transaction processing. Details for the operation of an exemplary RFID transaction completion system is found in U.S. patent application Ser. No. 10/192,488, entitled "SYSTEM AND METHOD FOR PAYMENTUSING RADIO FREQ ENCY IDENTIFICATION IN CONTACT AND CONTACTLESS TRANSACTIONS," and its progeny which are hereby incorporated by reference.

Figure 19:
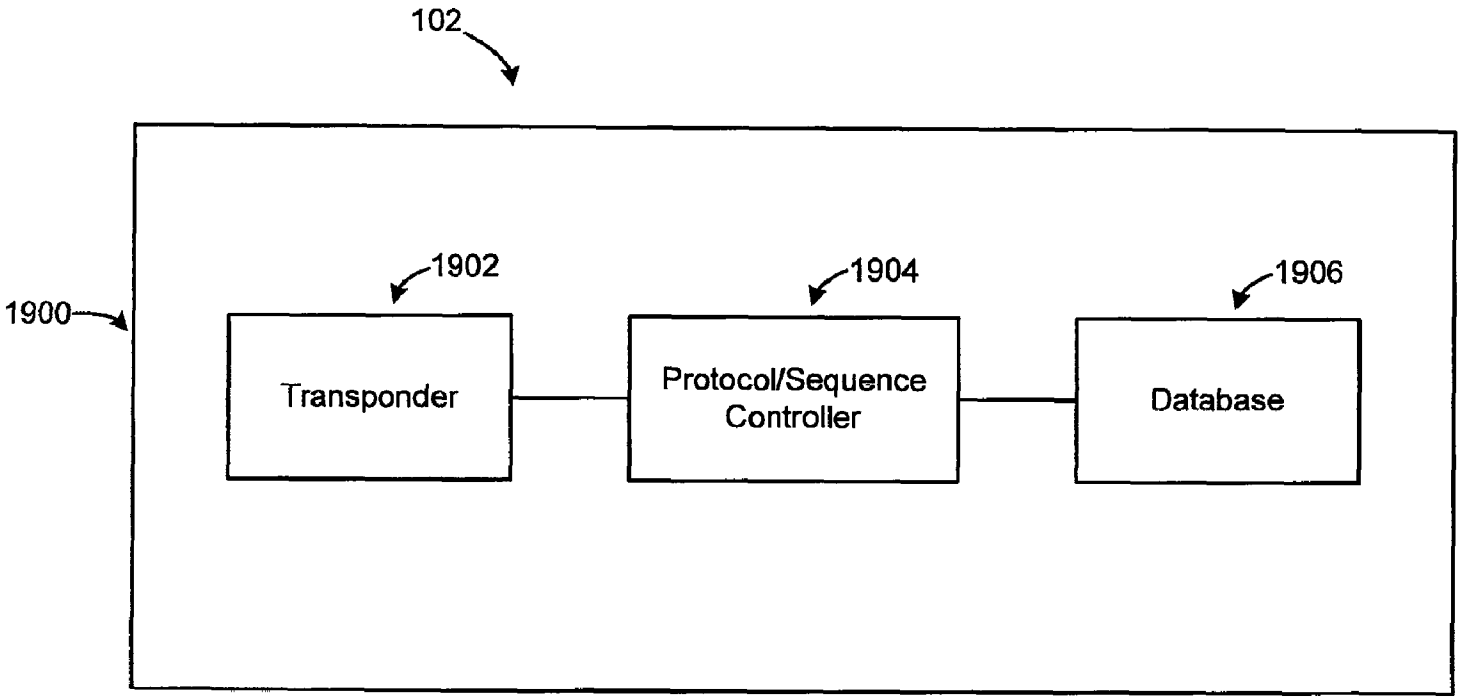
FIGURE 19 (PRIOR ART)
FIG. 19 illustrates an exemplary prior art RFID module useful with the present invention.

RFID module 102 includes any conventional RFID operable device, and as such, will only be briefly described with reference to FIG. 19. In general, RFID module 102 includes module housing 1900 including an RF transponder 1902 for sending and receiving data via RF, a database 1906 for storing RFID device transaction account data, and a protocol sequence controller 1904 for managing the retrieving of the transaction account data from database 1906. RF transponder 1902 receives the interrogation signal provided by RFID reader 104, and provides the interrogation signal to protocol sequence controller 1904. Protocol sequence controller 1904 then recognizes the interrogation signal as a request for data and retrieves the transaction account identifier from the database 1906. Protocol sequence controller 1904 then provides the transaction account identifier to transponder 1902 for providing to RFID reader 104 via RF transmission. For a complete description of a suitable RFID module and supporting circuitry that is operable with the present invention refer to U.S. patent application Ser. No. 10/192,488, noted above.

RFID reader 104 includes any conventional RFID reader configured to provide an interrogation signal and receive a transaction account identifier from an RFID transaction device. RFID reader 104 communicates with RFID module 102 via an antenna 106. Antenna 106 may be configured as an external and/or internal antenna. Additionally, RFID reader 104 is in communication with a merchant system 130 via a suitable data link for providing the transaction account identifier thereto. In one exemplary embodiment, merchant system 130 includes a POS device 110 in communication with an RFID reader 104 (via a data link), for receiving the transaction account identifier.

POS 110 is any device capable of receiving transaction account information from RFID reader 104 and forwarding the information to an account provider for transaction completion. In this regard, POS 110 is any point-of-interaction device or transaction device acceptance device as is known in the art.

POS 110 receives the transaction account identifier and provides the transaction account identifier to an account provider 140 via a network for transaction completion. Account provider 140 includes any entity facilitating completion of a transaction using an RFID module, and includes systems permitting transaction completion using at least one of a preloaded and non-preloaded account. Typical account providers may be, for example, American Express®, MasterCard®, Visa®, Discover®, and the like.

A transaction account identifier, as used herein, includes any identifier for an account (e.g., credit, charge, debit, checking, savings, reward, loyalty, or the like) which is maintained by a transaction account provider (e.g., payment authorization center) and which is used to complete a financial transaction. A typical account identifier (e.g., account data) is correlated to a credit or debit account, loyalty account, or rewards account maintained and serviced by the typical account provider noted above.

A transaction account identifier includes, for example, a sixteen-digit credit card number, although each transaction account provider has its own numbering system, such as the fifteen-digit numbering system used by American Express®. The transaction account identifier is stored on database 1906 as Track 1 and Track 2 data as defined in ISO/IEC 7813, and further is made unique to RFID module 102. In one exemplary embodiment, the transaction account identifier includes a unique module serial number and consumer identification number, as well as specific application applets. Database 1906 is configured to store multiple account identifiers issued by the same or different account providing institutions. Where the account identifier corresponds to a loyalty or rewards account, the database 1906 is configured to store the attendant loyalty or rewards points data.

Figure 2:
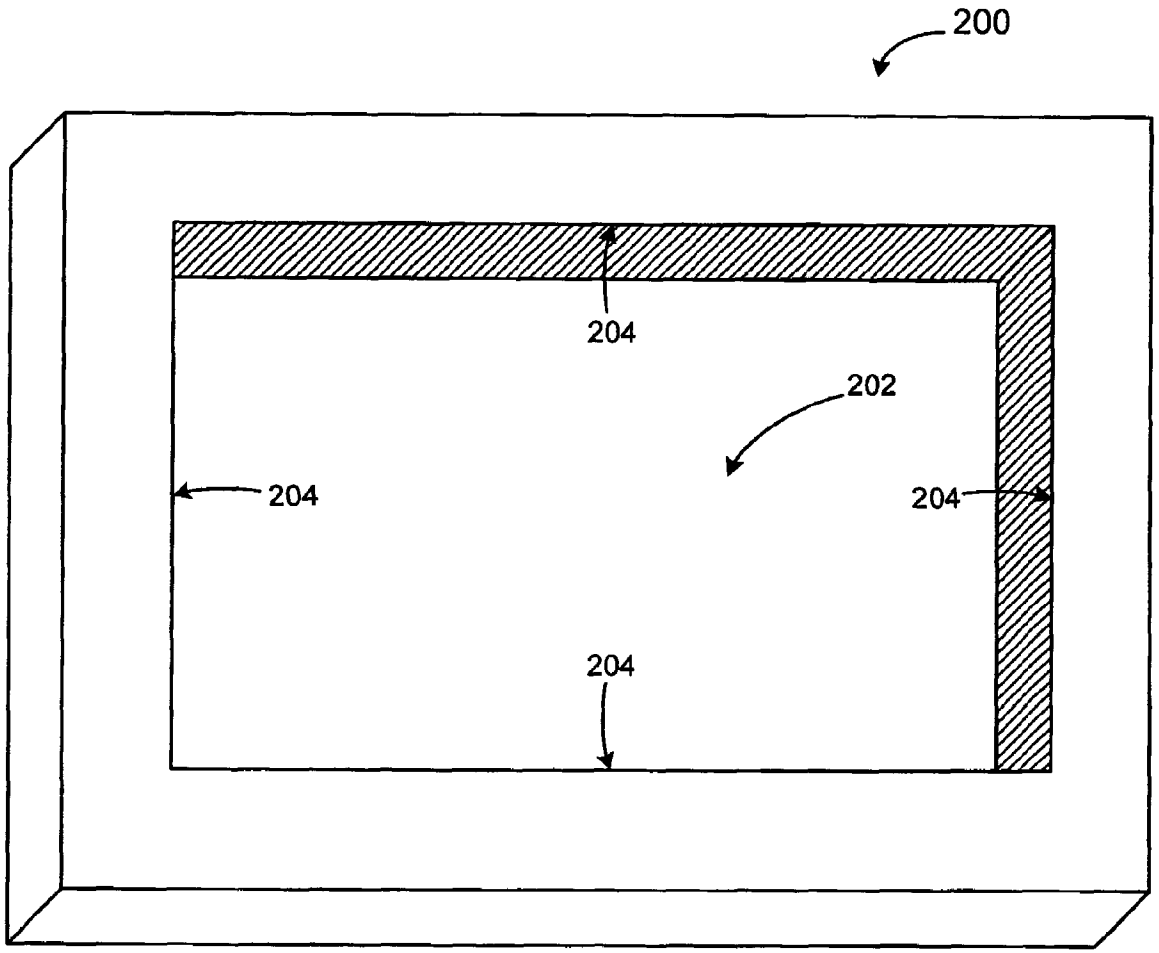
FIG. 2 illustrates an exemplary RFID carrier housing in accordance with an exemplary embodiment of the present invention.

One advantage of RFID technology is that the technology can be embodied in a diminutive form factor that is easily secured. For example, RFID technology may be embodied in an RFID module 102 of about one inch by one inch. In one embodiment, RFID module 102 is secured in an RFID module carrier housing 200 shown in FIG. 2. Although carrier housing 200 is depicted as being rectangular in shape, carrier housing 200 may be any size and shape suitable for encasing RFID module 102. Carrier housing 200 is comprised of any rigid material such as, for example, hard plastic, metal or metal-like material or the like, which is operable to secure RFID module 102 and to protect module 102 from contact by environmental forces. In one embodiment, when RFID module 102 is attached to carrier housing 200, housing 200 and/or RFID module 102 is configured with a securing mechanism, such as, for example a snap, Velcro, hinge, or the like, to ensure that RFID module 102 does not fall out of carrier housing 200. As shown, carrier housing 200 includes a recess 202 of sufficient depth to securely fit RFID module 102 therein. As such, the shape of recess 202 may be of similar dimensions as RFID module 102.

Figure 3:
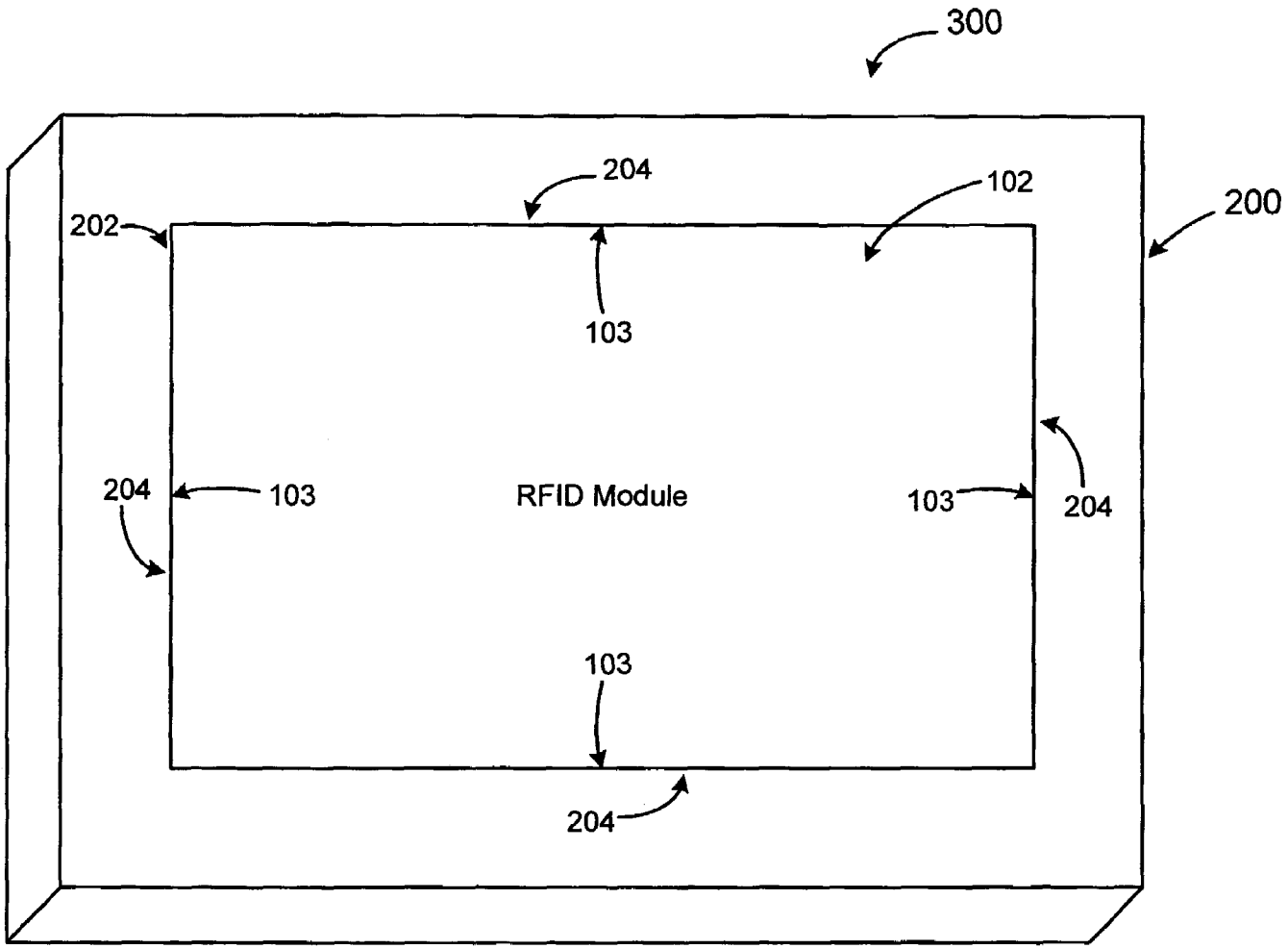
FIG. 3 illustrates an exemplary RFID carrier housing and RFID module in accordance with an exemplary embodiment of the present invention.

FIG. 3 depicts an exemplary RFID module carrier housing 200 wherein RFID module 102 is firmly fitted in recess 202, thereby forming an RFID transaction device 300. RFID module 102 is secured in recess 202 using any attachment method such as, for example, adhesive, screws, clips, and/or the like. RFID module 102 is secured in housing 200 by providing a cover (not shown) of substantially similar shape as recess 202 overlying RFID module 102 and secured to housing 200 when positioned in recess 202. The cover is constructed of similar material as housing 200. As such, when positioned overlying RFID module 102, the cover shields RFID module 102 from environmental contact.

Figure 4:
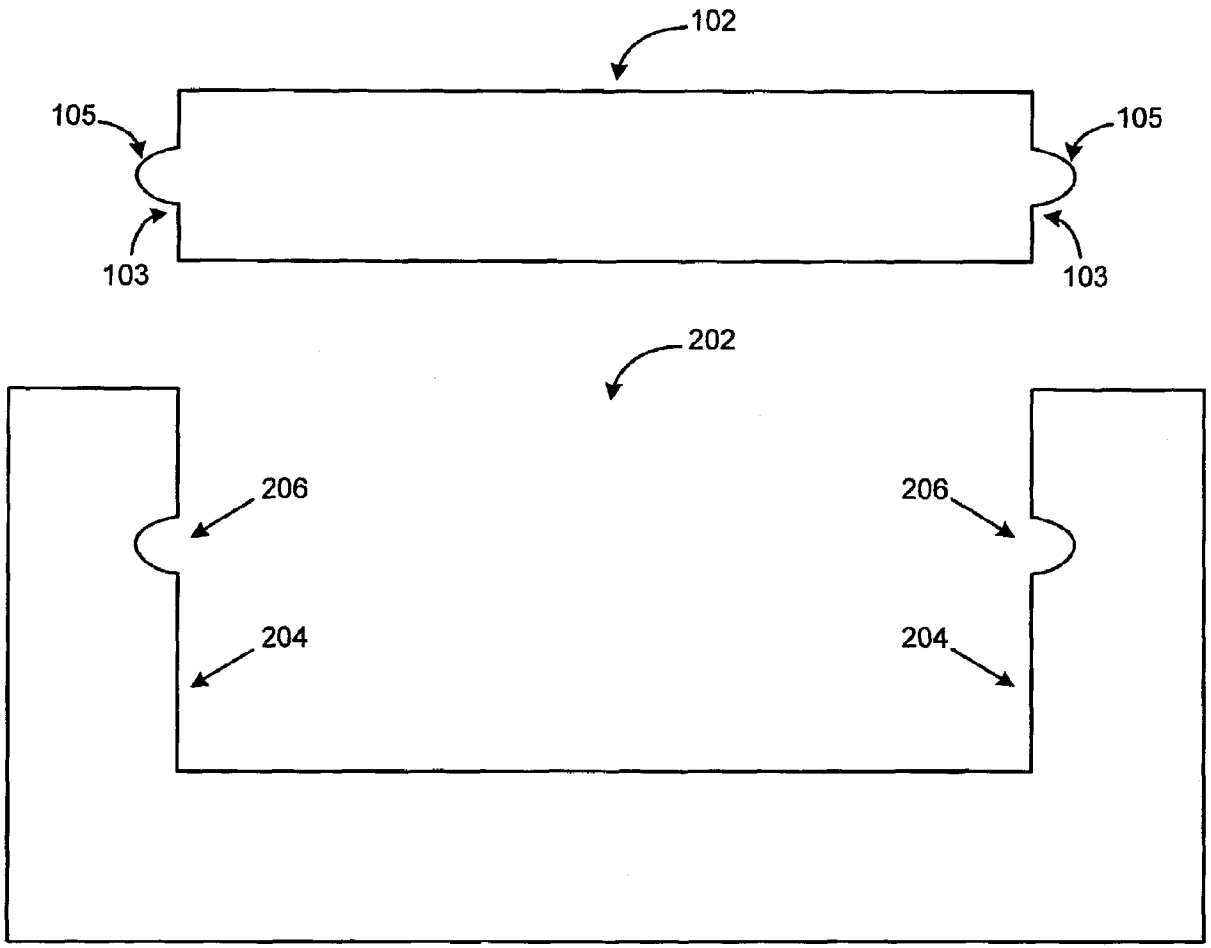
FIG. 4 illustrates an exemplary RFID carrier housing and RFID module in cross section in accordance with an exemplary embodiment of the present invention.

In one exemplary embodiment, RFID module 102 is fabricated to securely snap into carrier housing 200 using mating grooves on recess side walls 204 and RFID module side walls 103. FIG. 4 depicts carrier housing 200 and RFID module 200 in cross section wherein recess grooves 206 are formed in female configuration in side walls 204 for receiving the RFID module grooves 105 which are formed in a mating male configuration. In this way, RFID module 102 is inserted and firmly held in recess 202 with a minimal application of force enabling the mating grooves 206 and 105 to abut.

Figure 5:
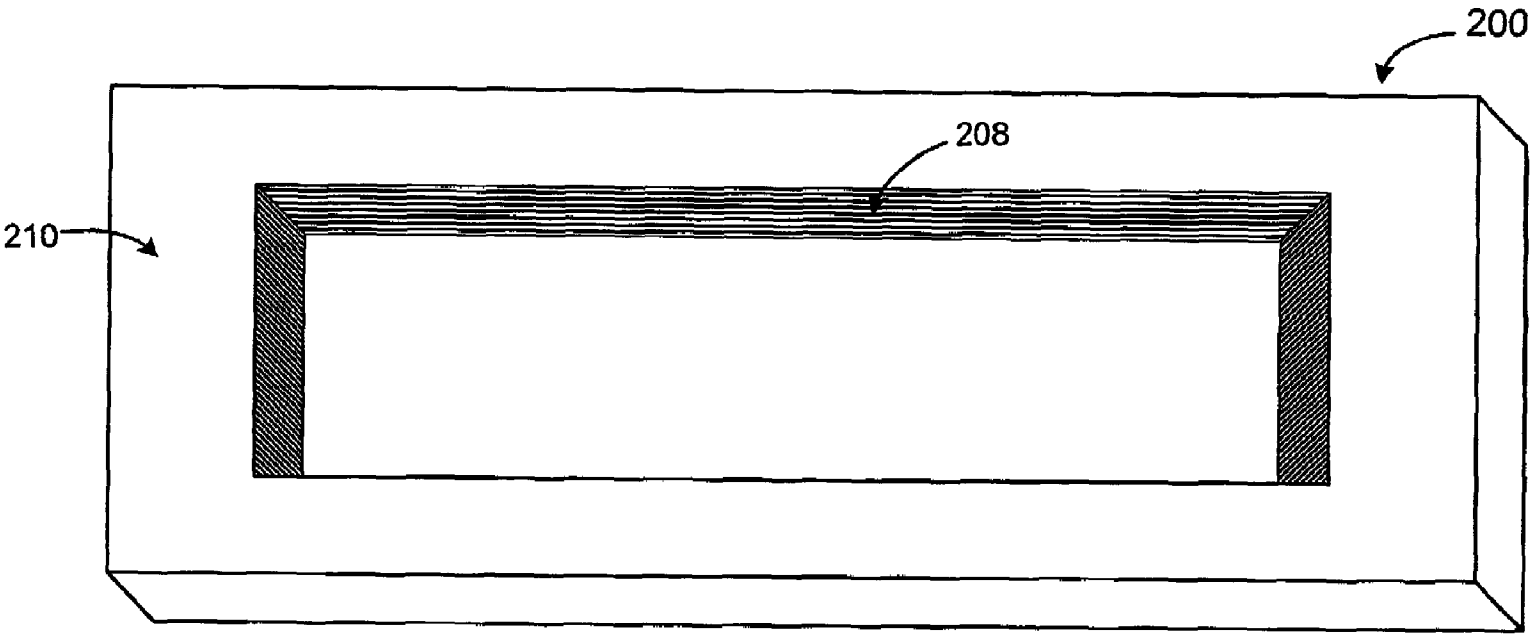
FIG. 5 illustrates an exemplary RFID carrier housing with lateral access for RFID module insertion in accordance with an exemplary embodiment of the present invention.

In an alternate embodiment shown in FIG. 5, carrier housing 200 includes a hollowed out enclosure 208 in the carrier housing 200 that provides access to a center portion of the housing 200 from a first lateral side 210 of the housing 200, for inserting the module 102 therein. The enclosure 208 is of substantially similar size and shape as RFID module 102, such that when inserted, RFID module 102 fits securely in recess 202. RFID module 102 is secured in carrier housing 200 by inserting module 102 in the enclosure 208 via the access provided. Enclosure 208 additionally includes mating grooves as described with respect to FIG. 4.

Figure 6:
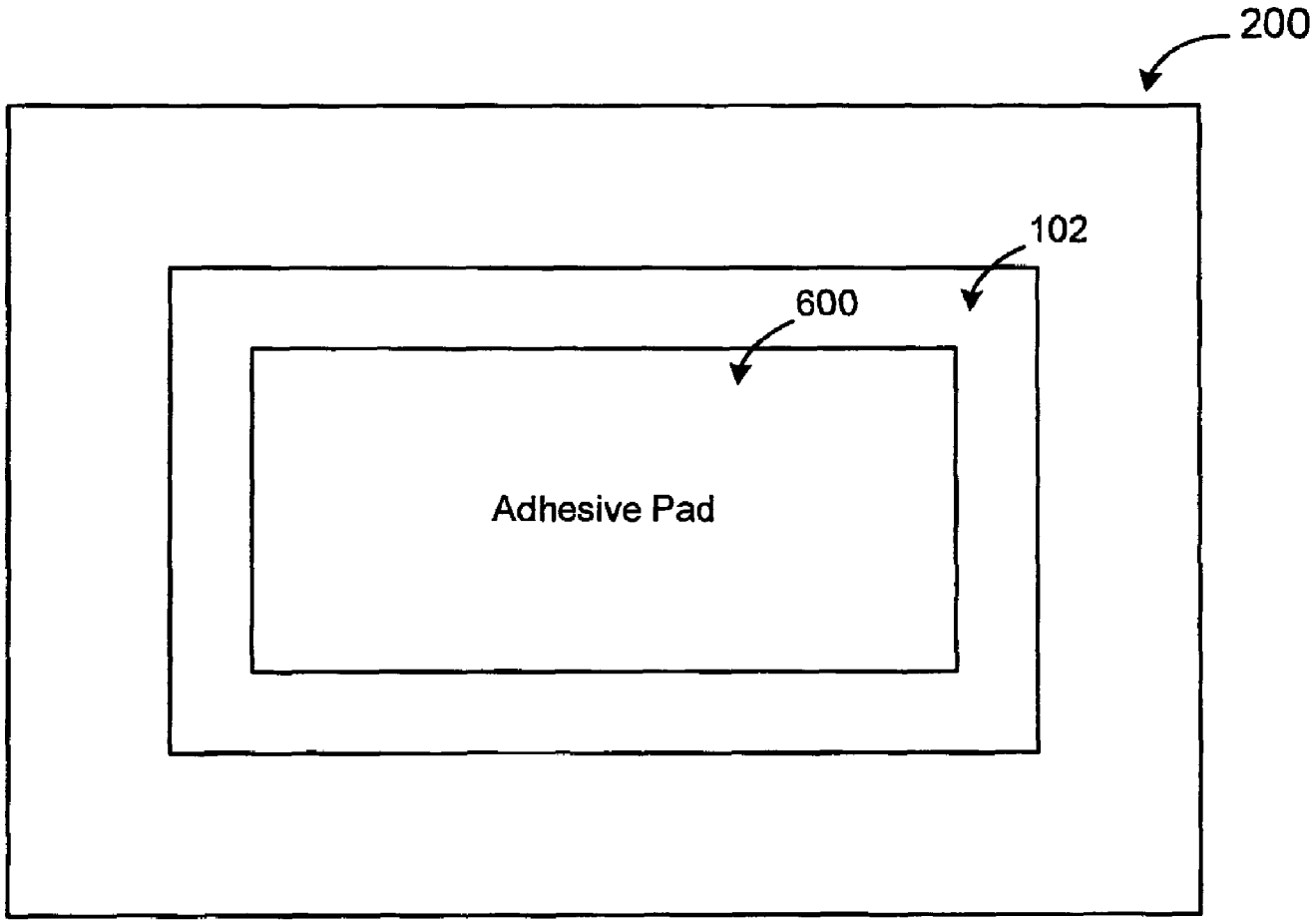
FIG. 6 illustrates an exemplary adhesive pad attachment apparatus in accordance with an exemplary embodiment of the present invention.

According to another embodiment, an RFID transaction device 300 includes an attachment apparatus enabling a consumer to affix device 300 to an article. "Attachment apparatus" includes any device enabling RFID transaction device 300 to be securely affixed to an article worn or carried by a consumer or to the consumer's person. FIG. 6 depicts an exemplary attachment apparatus in accordance with the invention. The attachment apparatus shown is an adhesive pad 600 affixed to one surface of RFID module 102 for enabling RFID transaction device 300 to be attached to a suitable attachment surface where the attached surface is a portion of the article to which RFID transaction device 300 is attached. For example, where adhesive pad 600 is a glue, RFID transaction device 300 is affixed to the attachment surface, wherein the attachment surface provides a surface area equal to or greater than the surface area of pad 600. Thus, if adhesive pad 600 is substantially planar in shape, then the attachment surface is also substantially planar in shape at the location where adhesive pad 600 contacts the attachment surface.

Suitable adhesive pad 600 includes an adhesive that permanently affixes RFID transaction device 300 to an article. Alternatively, pad 600 includes an adhesive that removably affixes RFID transaction device 300 to the article. In such an embodiment, pad 600 is a two-sided tape. The adhesive included in pad 600 includes a pull strength in the range of about 4 oz./sq. in. to about 64 oz./sq. in. The pull strength of the adhesive is sufficient to hold RFID transaction device 300 attached to an article, but is not so adhering that a consumer needs to apply an extraordinary force to intentionally remove RFID transaction device 300 from the article. The adhesive may be such that the adhesive substantially covers the entire surface of pad 600 contacting the article, but covers sufficient surface to firmly bond RFID transaction device 300 to the article.

In an alternate embodiment, adhesive pad 600 is replaceable, such as, when the adhesive character of pad 600 is diminished through use or damage. In such an embodiment, adhesive pad 600 is removed and replaced with a replacement adhesive pad as desired. A consumer need only remove pad 600 from carrier housing 200 and replace pad 600 with a substantially unused pad 600 of similar construction. This embodiment is useful when pad 600 comprises a two-sided tape construction.

In an alternate embodiment, adhesive pad 600 is comprised of a Velcro®-like material. In this instance, RFID transaction device 300 is affixed to an attachment surface having an irregular pattern to support Velcro® mating properties. For example, RFID transaction device 300 is affixed to a terry cloth, wool, or other material with a surface that has a surface capable of being hooked by the Velcro® materials. The adhering properties of Velcro® in this regard are well understood and will not be discussed herein in detail.

Figure 7:
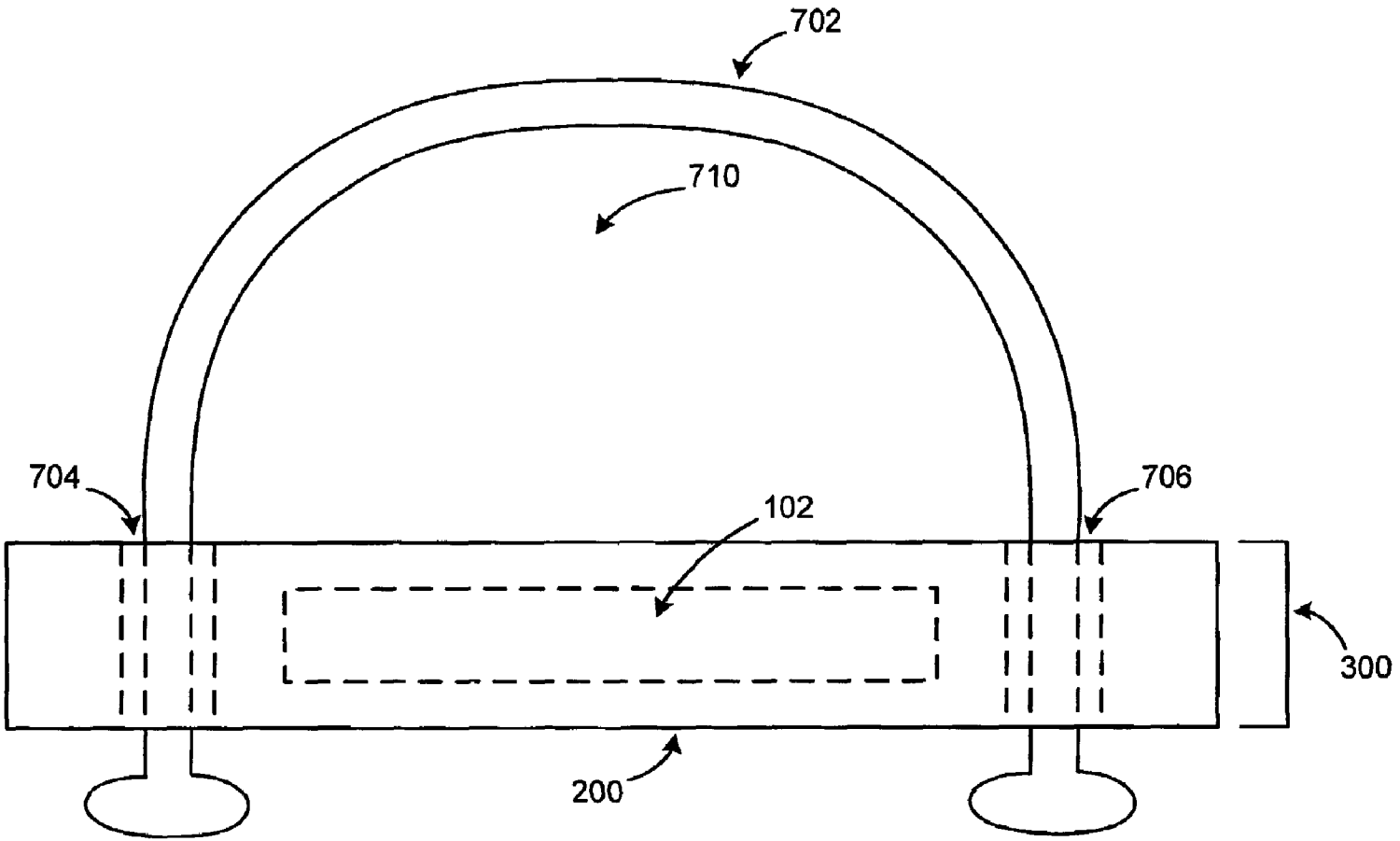
FIG. 7 illustrates an exemplary elastic band attachment apparatus in accordance with an exemplary embodiment of the present invention.

FIG. 7 depicts another exemplary embodiment of an attachment apparatus. As shown, the attachment apparatus comprises an elastic band 702 that is affixed to carrier housing 200. Elastic band 702 is affixed to housing 200 at a first housing end location 704 and a second opposing housing end location 706. In one embodiment, housing end location 704, 706 are apertures that proceed through the housing 200 to provide an opening laterally therethrough. A first end of band 702 is inserted in the housing end location 704 and knotted so that the first end of band 702 is not easily removed. Similarly, a second end of band 702 is inserted in the housing end location 706 and knotted so that the second end of band 702 is not easily removed. In this way, band 702 is securely fastened to housing 200 so that band 702 is anchored to housing 200 at the first and second housing end locations 704, 706 described above. Alternatively, the first and second band ends are affixed to housing 200 by any affixing means such as, for example, glue, clips, clamps and/or the like.

To secure the RFID transaction device of FIG. 4 to an article, elastic band 702 is stretched (e.g., lengthened) to provide a loop 710 between band 702 and carrier housing 200, and an article is inserted in loop 710 provided. By applying a stretching force to extend the circumference of band 702, band 702 distorts or elongates, thereby enlarging the circumference of loop 710. However, the elastic nature of band 702 causes band 702 to return to its original undistorted relaxed state when the stretching force is removed. While stretching, band 702 provides an opening (e.g., loop 710) between band 702 and housing 200. When the stretching force is relaxed, band 702 constricts and returns to its original state, thereby reducing the circumference of the opening. As such, an article placed in loop 710 will be grasped by constricting band 702 securing RFID transaction device 300 such that it is substantially unmovable with respect to the article. If the consumer desired to attach RFID transaction device 300 to the consumer's wrist, then this embodiment is desirable. The consumer would stretch band 702 by exerting a pressure on band 702 that is substantially away from carrier housing 200. The exertion of pressure causes band 702 to lengthen, enlarging loop 710 between band 702 and housing 200 sufficiently to permit the consumer to insert his wrist therebetween. Because band 702 is elastic, band 702 stores elastic energy that is released by permitting band 702 to return to its previously unstretched or relaxed position. However, since the consumer's wrist is inserted in enlarged loop 710 created by the stretching process, band 702 is prevented from completely returning to its relaxed state and a portion of the elastic energy in band 702 remains. This permits band 702 to grasp the consumer's wrist securing RFID transaction device 300 thereto.

Figure 8:
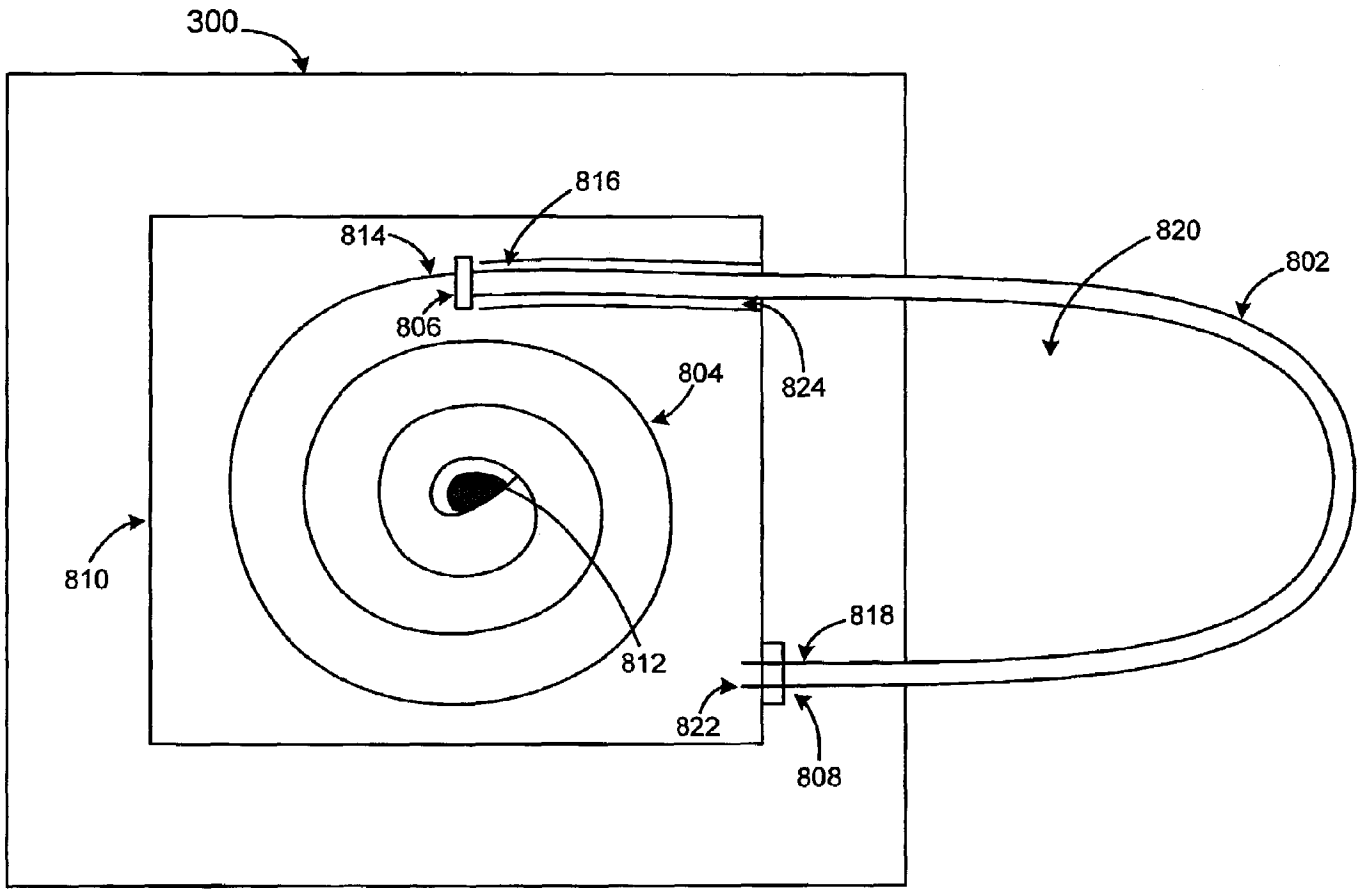
FIG. 8 illustrates an exemplary retractable band attachment apparatus in accordance with an exemplary embodiment of the present invention.
Figure 9:
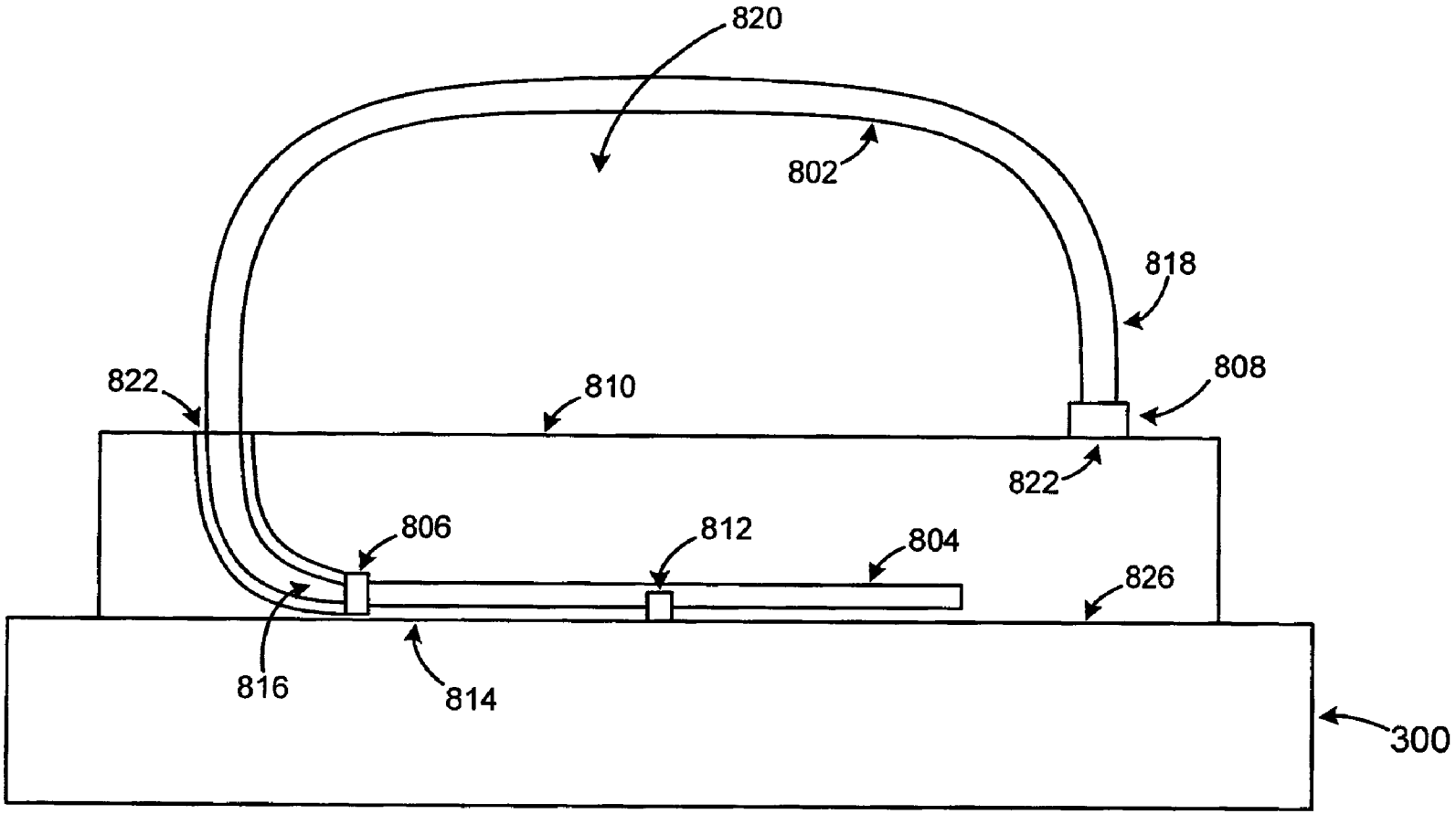
FIG. 9 illustrates an exemplary retractable band attachment apparatus in cross section in accordance with an exemplary embodiment of the present invention.

FIGS. 8 and 9 depict another exemplary embodiment of the attachment apparatus for securing RFID transaction device 300 that uses a spring 804 affixed to a band 802 for supporting the elastic energy for grasping an article in a similar manner as was discussed with respect to band 702. Suitable springs include flat coiled springs configured to provide tension when the coils are tightly wound. Springs include, for example, clock springs, torsion springs and/or the like.

With reference to FIG. 8, the spring-enabled attachment apparatus is shown affixed to RFID transaction device 300 and comprises an attachment apparatus housing 810 including spring 804 attached to attachment apparatus housing 810 at a first spring end 812. A first end 816 of band 802 is attached at a second spring end 814. A second end 818 of band 802 is affixed to attachment apparatus housing 810 at attachment apparatus housing location 822 substantially opposite the location where the first end 816 of band 802 is attached to spring 804, thereby creating a loop 820 into which a consumer inserts an article to which RFID transaction device 300 is secured. First end 816 of band 802 is affixed to second spring end 814 using any conventional attachment means 806 enabling spring 804 to be securely fastened to band 802. Second end of band 802 is attached at second housing location 808. An exemplary attachment device 806 includes a clamp, rivet, screw, adhesive, and/or the like.

FIG. 9 illustrates the attachment apparatus and RFID transaction device 300 in cross-section from a side view. As shown, attachment apparatus housing 810 is affixed to first surface 826 of RFID transaction device 300. In an alternate embodiment, apparatus housing 810 is formed integral to RFID carrier housing 200. Attachment apparatus housing 810 includes a channel 822 into which band 802 is threaded for attachment to spring 804. Channel 822 is arched so that band 802 enters into channel 822 at a position perpendicular to first surface 826 of RFID transaction device 300 and exits channel 822 substantially parallel to first surface 826. In an alternate embodiment, channel 822 is substantially parallel to surface 826 such that band 802 enters and exits channel 822 in a substantially parallel position.

Band 802 is removed from channel 822 by exerting a force on a portion of band 802 outside channel 822 in a direction away from spring 804, and is retracted into channel 822 by spring 804 when the removing force is partially or fully released. When band 802 is removed thusly, loop 820 between attachment apparatus housing 810 and band 802 increases in circumference, and spring 804 stores elastic energy as the coils of spring 804 are tightened. The elastic energy causes spring 804 to exert a force on band 802 relative to the amount of the removing force. A consumer inserts an article in loop 820 and releases the removing force resulting in band 802 grasping the article inserted in loop 820. Notably, band 802 may be elastic, thereby increasing the overall elastic energy in the attachment apparatus.

Figure 10:
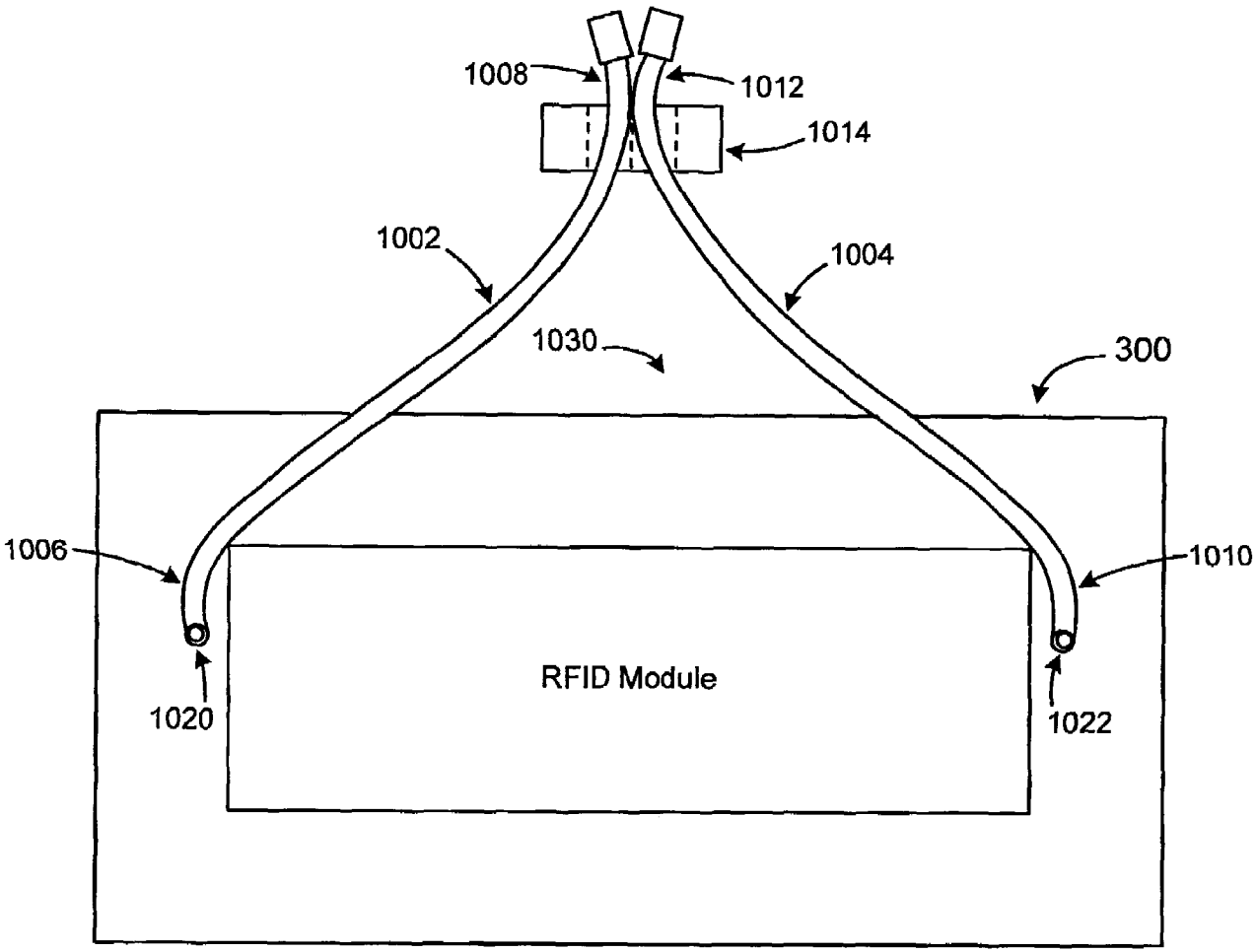
FIG. 10 illustrates an exemplary drawstring attachment apparatus in accordance with an exemplary embodiment of the present invention.

FIG. 10 illustrates another exemplary embodiment of an attachment apparatus useful with the present invention. As shown, the attachment apparatus is a drawstring attachment system affixed to RFID transaction device 300. The attachment apparatus comprises a first string 1002 having a first string end 1006 attached to carrier housing 200 at a first location 1020 and a second string 1004 having a string first string end 1010 attached a carrier housing 200 at a second location 1022, where the attachment device is similar to any attachment device described herein. In one embodiment, the first location 1020 is positioned distant from the second location 1022, though the first location 1020 and second location 1022 are positioned in proximity one to the other.

A second end 1008 of first string 1002 and a second end 1012 of second string 1004 is threaded through a slideable string fastener 1014 capable of immovably locking a portion of first string 1002 and second string 1004 in proximity to each other. In this position, a loop 1030 is defined by RFID transaction device 300, first string 1002, second string 1004, and fastener 1014. Suitable string fasteners useful with this invention include fasteners operable to immovably tighten along the length of string 1002 and 1004 at any desired location. Exemplary fasteners include a drawstring tightening member, drawstring clamp or cord lock fastener, and/or the like as are found in the art. The operation of such fasteners are well known and will not be discussed in detail herein.

Briefly, string fastener 1014 is locked such that fastener 1014 tightens at any desired position along the length of first string 1002 and second string 1004. In one instance, fastener 1014 is configured to tighten in proximity to first string end 1008 and second string end 1012, thereby increasing the circumference of loop 1030 between RFID transaction device 300 and fastener 1014. To attach RFID transaction device 300 to an article, fastener 1014 is tightened along the length of first string 1002 and second string 1004 in proximity to carrier housing 200 with the article interposed in loop 1030 such that first string 1002 and second string 1004 tighten around the article.

Figure 11:
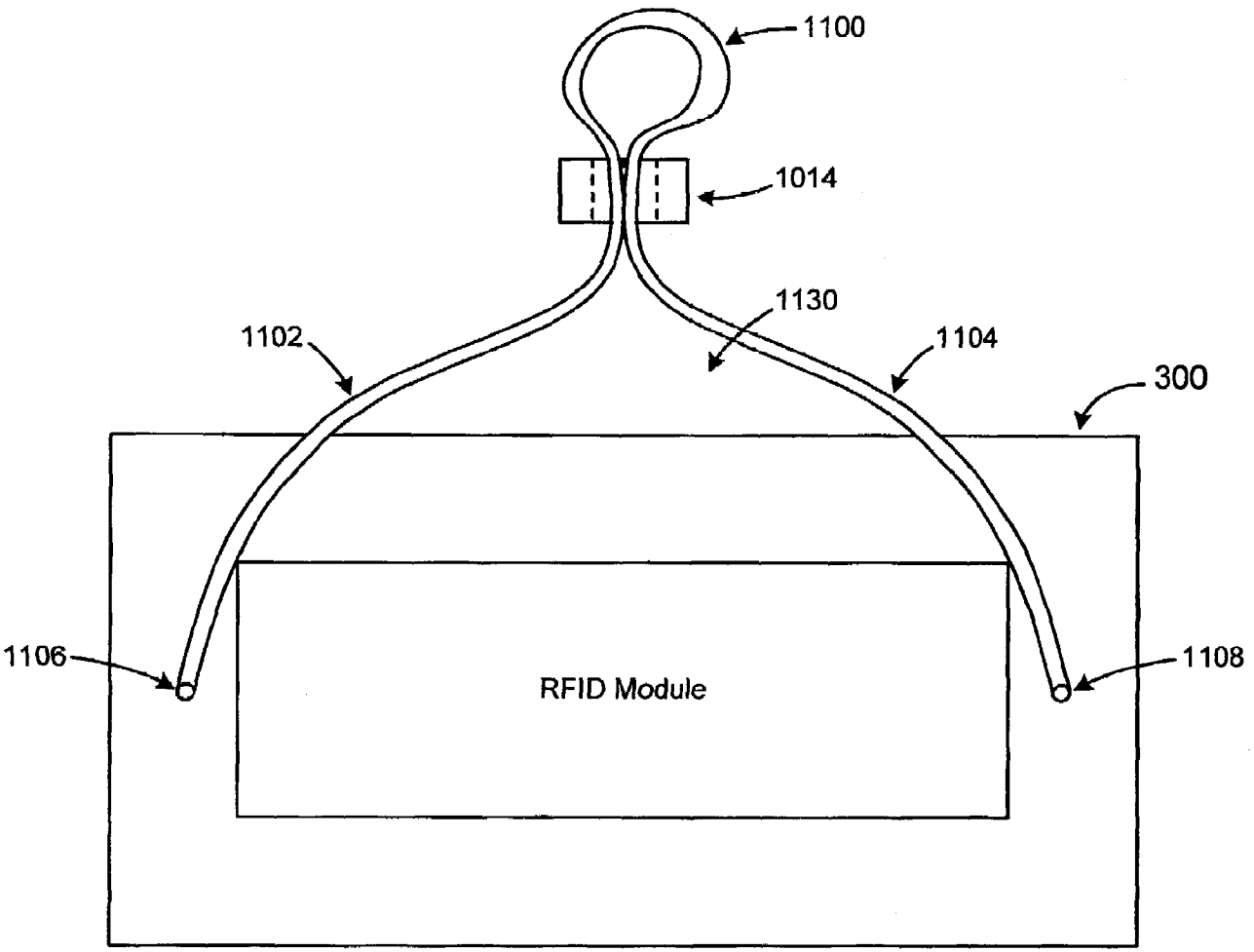
FIG. 11 illustrates an alternate embodiment of an exemplary drawstring attachment apparatus in accordance with an exemplary embodiment of the present invention.

Although the embodiment described with respect to FIG. 10 is discussed in terms of a first string 1002 and a second string 1004, the embodiment is not so limited. FIG. 11 depicts an attachment apparatus comprising a single string 1100 that is threaded through fastener 1014 such that a loop 1130 is defined by a first string side 1102 on a first portion of string 1100 and a second string side 1104 on a second opposing portion of string 1100. First string side 1102 is attached at a first location 1106 to RFID transaction device 300, and second string side 1104 is attached to a second location 1108 to RFID transaction device 300. In this way, the circumference of loop 1130 is configured larger or smaller by adjusting the location of fastener 1014 along first string side 1102 and second string side 1104. To enlarge the loop 1130, such as for inserting an article around which loop 1130 is tightened, fastener 1014 is moved along first string side 1102 and second string side 1104 away from RFID transaction device 300. Alternatively, to tighten loop 1130 around an article inserted in loop 1130, fastener 1014 is tightened along first string side 1102 and second string side 1104 in proximity to RFID transaction device 300, thereby attaching RFID transaction device 300 to the article.

Figure 13:
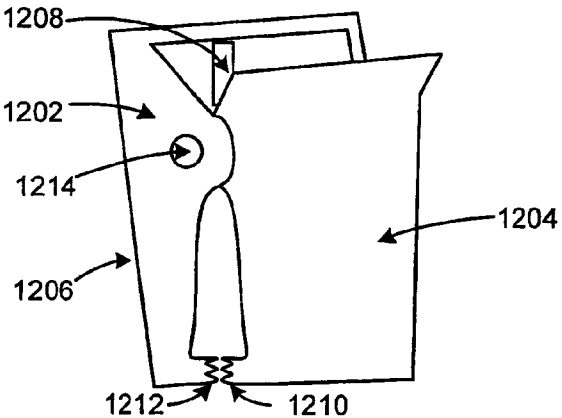
FIG. 13 illustrates an exemplary spring biased clamp attachment apparatus in accordance with an exemplary embodiment of the present invention.
Figure 12:
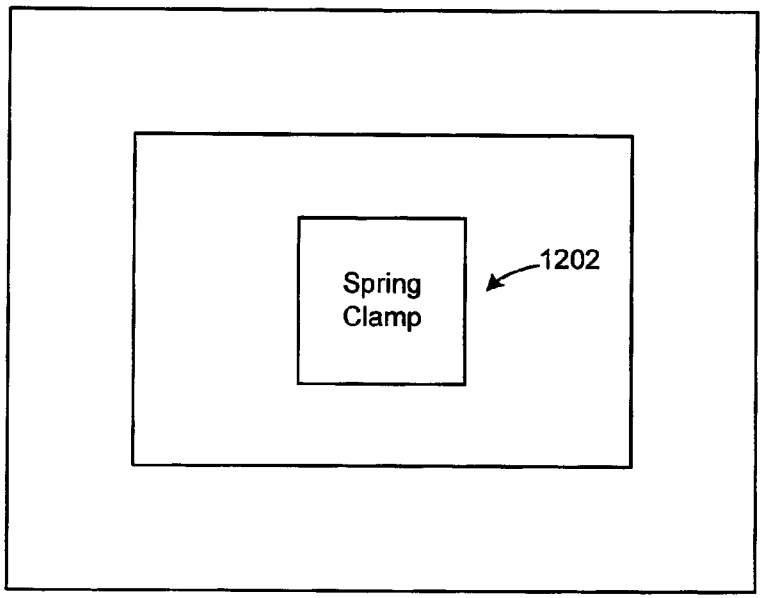
FIG. 12 illustrates an exemplary RFID transaction device using a spring biased clamp attachment apparatus in accordance with an exemplary embodiment of the present invention.

FIG. 12 depicts yet another embodiment of an attachment apparatus useful with the present invention comprising a spring biased clamp 1202 affixed to carrier housing 200 using any suitable affixing or attaching means described herein. As shown in FIG. 13, spring biased clamp 1202 includes an upper jaw 1204 having a gripping sector 1210 and a substantially identical opposing lower jaw 1206 having a gripping sector 1212. Jaws 1204 and 1206 are configured to pivot around a pin 1214, which serves as a fulcrum. Gripping sectors 1210, 1212 are held in abutment one to the other by a spring 1208 when spring 1208 is in a relaxed position. Jaws 1204 and 1206 are placed in non-abutment by placing pressure on the back of jaws 1204, 1206 opposite the jaws gripping sectors 1210, 1212. Upper jaw 1204 and lower jaw 1206 are formed to pivot around pivot pin 1208 for angularly opening and closing jaws 1204, 1206.

Figure 14:
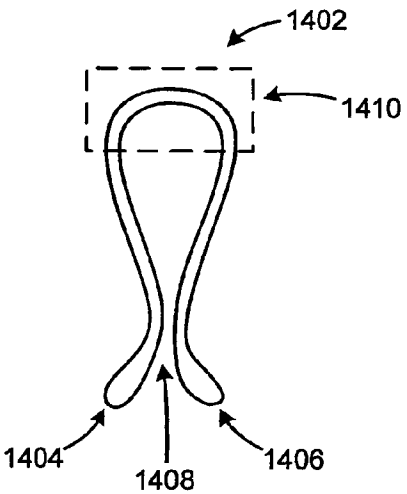
FIG. 14 illustrates an exemplary molded clamp attachment apparatus in accordance with an exemplary embodiment of the present invention.

In an alternate embodiment, clamp 1202 is a single molded clamp (e.g., clamp 1402) as is shown in FIG. 14. Clamp 1402 is molded from plastic, metal or metal-like material or other rigid material operable to store elastic energy, for example, in a curved portion 1410 of clamp 1402. Clamp 1402 includes a first gripping end 1404 that is molded to be fixed in proximity to a second gripping end 1406 such that gripping ends 1404,

1406 form a narrow passageway 1408 for the insertion of an article for attaching RFID transaction device 300 thereto. Molded clamps are well known in the industry and will not be discussed herein in detail. For additional information on suitable clamps for use with the invention, refer to U.S. Pat. No. 4,175,306, issued to Bigelow et al., U.S. Pat. No. 4,012,811, issued to Mazzaferro, U.S. Pat. No. 3,698,043, issued to Batts, and U.S. Pat. No. 3,737,943 issued to Störe, and the like, incorporated herein by reference.

Figure 15:
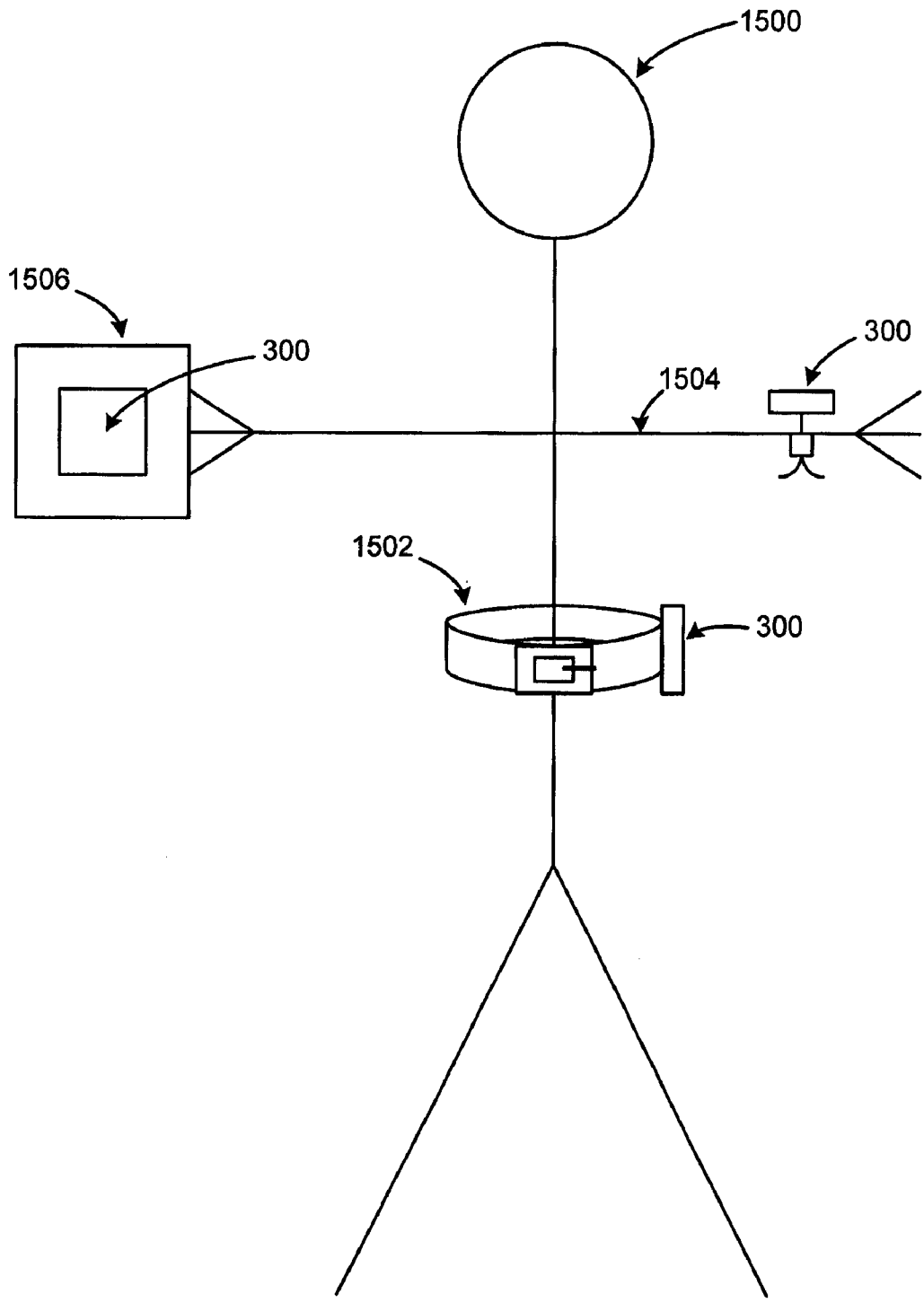
FIG. 15 illustrates various exemplary attachment apparatus in use on consumer clothing, appendage and accessory in accordance with the present invention.

FIGS. 15-18 illustrate by example, RFID transaction device 300 attached using any of the attachment apparatuses described above. As shown in FIG. 15, consumer 1500 alternately attaches RFID transaction device 300 to an article, such as, for example, clothing 1502 worn by consumer 1500, a consumer's appendage 1504, or an accessory 1506 carried by the consumer.

Figure 16:
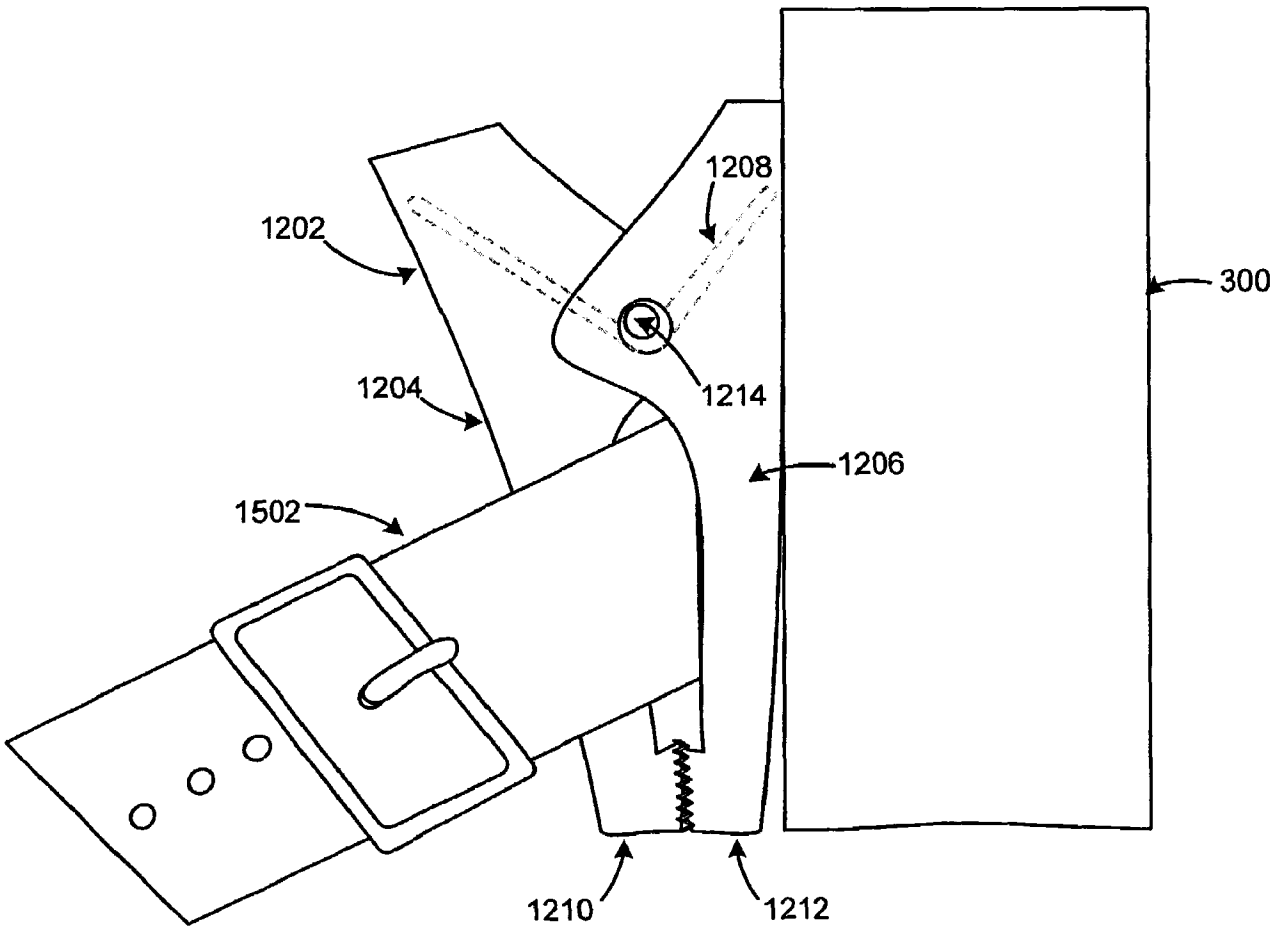
FIG. 16 illustrates an exemplary attachment apparatus according to the invention attaching an RFID transaction device to a consumer's clothing in accordance with the present invention.

FIG. 16 illustrates RFID transaction device 300 attached to a consumer's clothing 1502, such as a belt (e.g., belt 1502), wherein belt 1502 is inserted in jaws 1212 and 1210, or 1404 and 1406.

Figure 17:
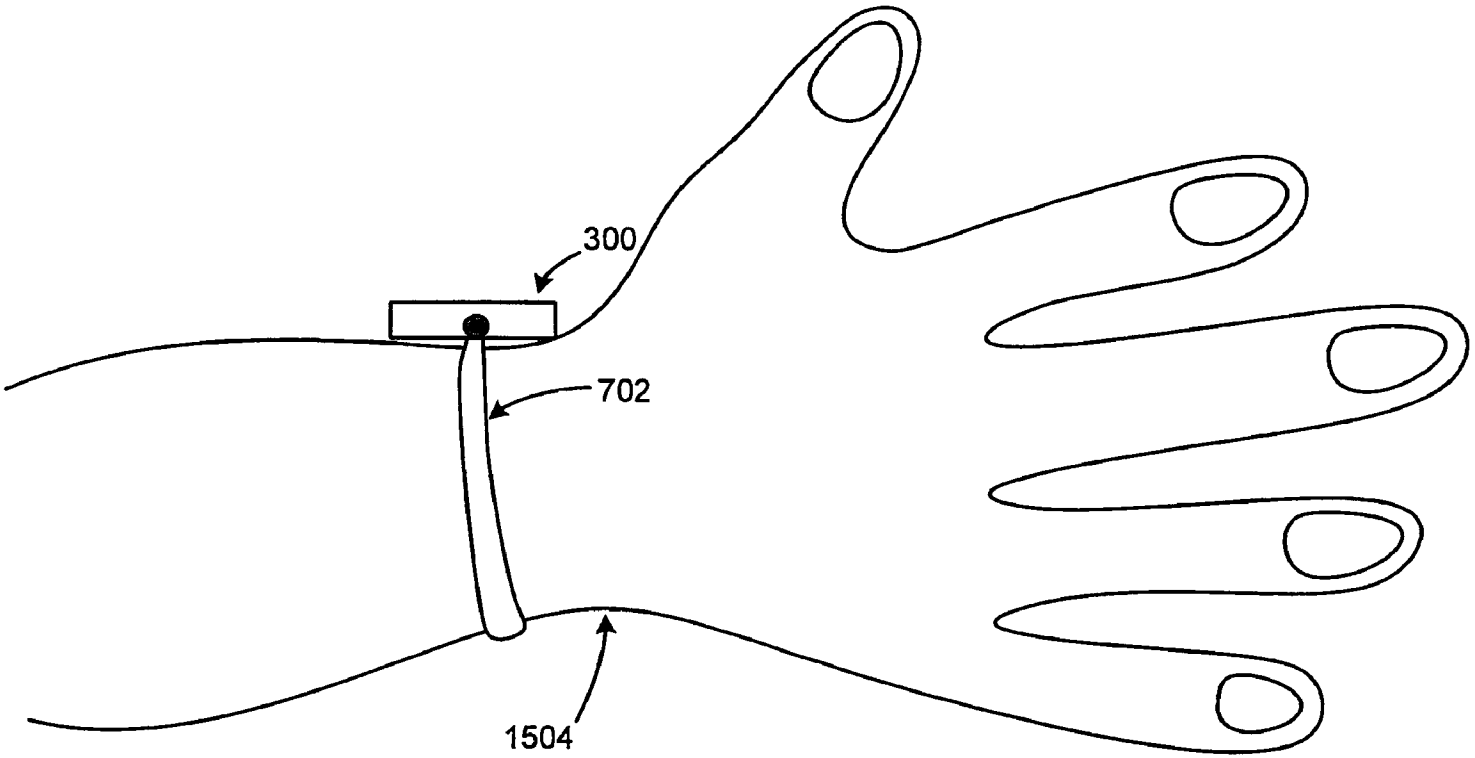
FIG. 17 illustrates an exemplary attachment apparatus according to the invention attaching an RFID transaction device to a consumer's appendage in accordance with the present invention.

FIG. 17 illustrates RFID transaction device 300 attached to a consumer's appendage 1504, such as, a consumer's wrist (e.g., wrist 1504), wherein wrist 1504 is inserted into a loop 710, 820, 1030, 1130. With specific reference to the embodiment shown in FIG. 7, elastic band 702 is lengthened to insert wrist 1504 into loop 710. Upon insertion, elastic band 702 is permitted to relax, thereby gripping wrist 1504 and attaching RFID transaction device 300 thereto.

Figure 18:
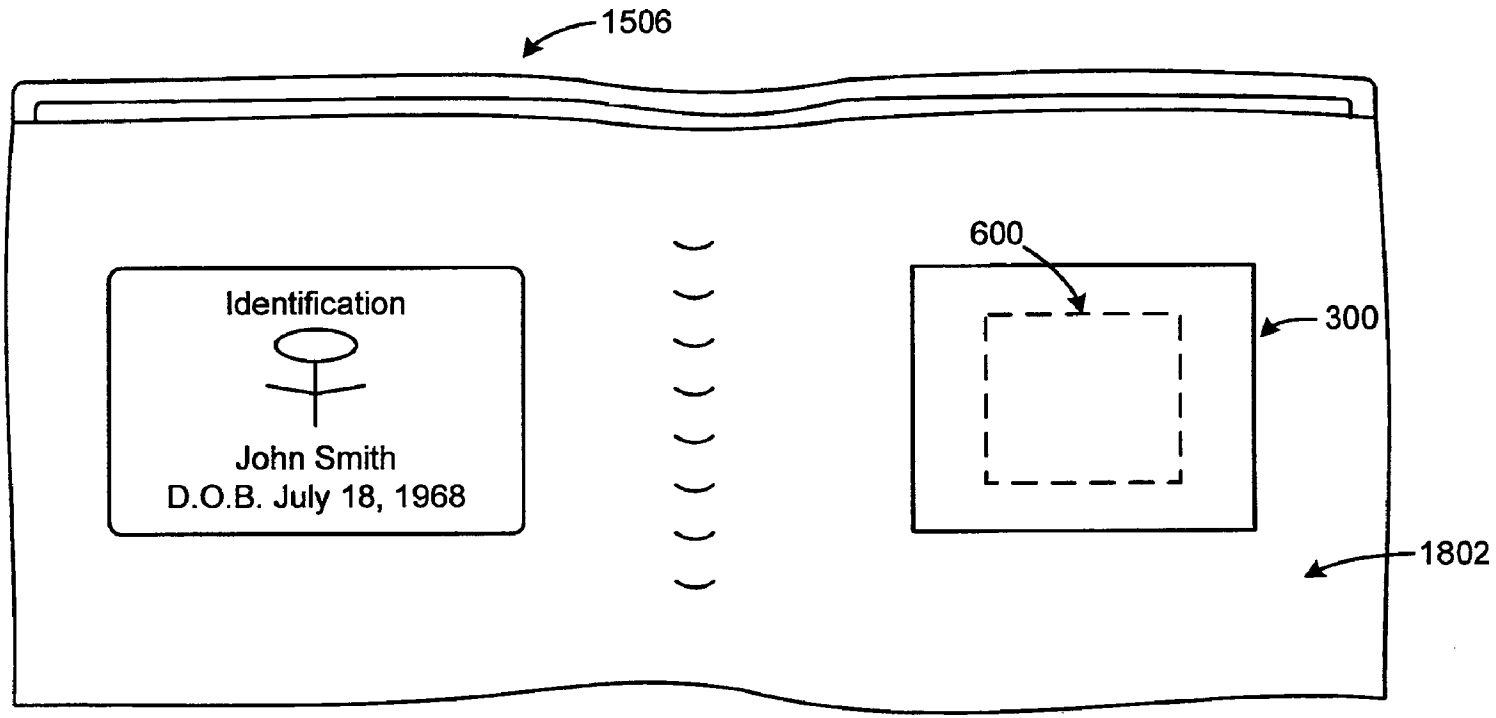
FIG. 18 illustrates an exemplary attachment apparatus attaching an RFID transaction device to a consumer's accessory in accordance with an exemplary embodiment of the present invention.

Finally, FIG. 18 illustrates RFID device 300 attached to an accessory 1506, such as, a billfold (e.g., billfold 1506) that is transported by consumer 1500. RFID transaction device 300 is attached to billfold 1506 using adhesive pad 600, which removably adheres to a first billfold surface 1802. In any of the embodiments illustrated, RFID transaction device 300 is secured using an attachment apparatus and consumer 1500 may present RFID transaction device 300 for transaction completion.

In another embodiment, RFID transaction device 300 is embedded into other form factors, for example, such as form factors 1502, 1506, 702, 1802 an/or the like illustrated in FIGS. 15-18. For example, with respect to FIG. 15, RFID transaction device 300 is embedded into articles such as clothing 1502 and/or accessory 1506. By embedding into a form factor, RFID transaction device 300 is partially and/or fully integrated within any part of the form factor. Alternatively and/or additionally, the electronics of RFID transaction device 300 communicate with the electronics of the form factor (for example, if the form factor is a PDA and/or other electronic device). The electronic form factor can therefore communicate controls and/or other information to RFID transaction device 300. In another example, the electronic controls of the form factor can be configured with an RFID protocol that facilitates the form factor itself to function as an RFID transaction device. RFID transaction device 300 can also be embedded such that it is fully or partially visible and/or not visible to the human eye.

Figure 20:
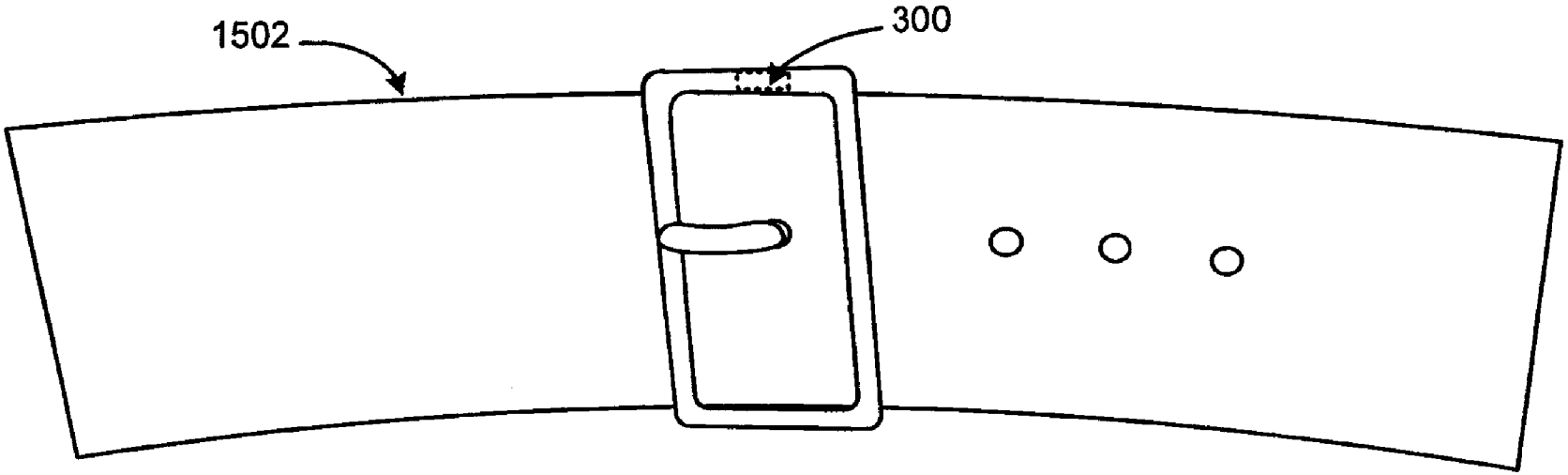
FIG. 20 illustrates an exemplary embedded RFID transaction device within a form factor in accordance with an exemplary embodiment of the present invention.

With respect to an exemplary embodiment depicted in FIG. 20, RFID transaction device 300 is embedded within form factor 1502 such that it is not readily visible. RFID transaction device 300 is embedded by any means to secure the device within the form factor. For example, RFID transaction device 300 can be inlaid within form factor 1502 or the like by inserting RFID transaction device 300 substantially within at least a portion of form factor 1502.

The present invention may be described herein in terms of functional block components, screen shots, optional selections and various processing steps. Such functional blocks may be realized by any number of hardware and/or software components configured to perform to specified functions. For example, the present invention may employ various integrated circuit components (e.g., memory elements, processing elements, logic elements, look-up tables, and the like), which may carry out a variety of functions under the control of one or more mircroprocessors or other control devices. Similarly, the software elements of the present invention may be implemented with any programming or scripting language such as C, C++, Java, COBOL, assembler, PERL, extensible markup language (XML), JavaCard and M LTOS with the various algorithms being implemented with any combination of data structures, objects, processes, routines or other programming elements. Further, it should be noted that the present invention may employ any number of conventional techniques for data transmission, signaling, data processing, network control, and the like. For a basic introduction on cryptography, review a text written by Bruce Schneier entitled "Applied Cryptography: Protocols, Algorithms, and Source Code in C," published by John Wiley & Sons (second edition, 1996), herein incorporated by reference.

In addition, many applications of the present invention could be formulated. The exemplary network disclosed herein may include any system for exchanging data or transacting business, such as the internet, an intranet, an extranet, WAN, LAN, satellite communications, and/or the like. It is noted that the network may be implemented as other types of networks, such as an interactive television network (ITN).

Further still, the terms "Internet" or "network" may refer to the Internet, any replacement, competitor or successor to the Internet, or any public or private inter-network, intranet or extranet that is based upon open or proprietary protocols. Specific information related to the protocols, standards, and application software utilized in connection with the Internet may not be discussed herein. For further information regarding such details, see, for example, Dilip Naik, Internet Standards and Protocols (1998); Java 2 Complete, various authors, (Sybex 1999); Deborah Ray and Eric Ray, Mastering HTML 4.0 (1997); Loshin, TCP/IP Clearly Explained (1997). All of these texts are hereby incorporated by reference.

By communicating, a signal may travel to/from one component to another. The components may be directly connected to each other or may be connected through one or more other devices or components. The various coupling components for the devices can include but are not limited to the Internet, a wireless network, a conventional wire cable, an optical cable or connection through air, water, or any other medium that conducts signals, and any other coupling device or medium.

Where desired, the system consumer may interact with the system via any input device such as, a keypad, keyboard, mouse, kiosk, personal digital assistant, handheld computer (e.g., Palm Pilot®, Blackberry®), cellular phone and/or the like. Similarly, the invention could be used in conjunction with any type of personal computer, network computer, work station, minicomputer, mainframe, or the like running any operating system such as any version of Windows, Windows NT, Windows 2000, Windows 98, Windows 95, MacOS, OS/2, BeOS, Linux, UNIX, Solaris or the like. Moreover, although the invention may frequently be described as being implemented with TCP/IP communications protocol, it should be understood that the invention could also be implemented using SNA, IPX, Appletalk, IPte, NetBIOS, OSI or any number of communications protocols. Moreover, the system contemplates the use, sale, or distribution of any goods, services or information over any network having similar functionality described herein.

A variety of conventional communications media and protocols may be used for data links providing physical connections between the various system components. For example, the data links may be an Internet Service Provider (ISP) configured to facilitate communications over a local loop as is typically used in connection with standard modem communication, cable modem, dish networks, ISDN, Digital Subscriber Lines (DSL), or any wireless communication media. In addition, the merchant system including a merchant Point-of-Sale (POS) device and host network may reside on a local area network which interfaces to a remote network for remote authorization of an intended transaction.

The preceding detailed description of exemplary embodiments of the invention makes reference to the accompanying drawings, which show the exemplary embodiment by way of illustration. While these exemplary embodiments are described in sufficient detail to enable those skilled in the art to practice the invention, it should be understood that other embodiments may be realized and that logical and mechanical changes may be made without departing from the spirit and scope of the invention. Thus, the preceding detailed description is presented for purposes of illustration only and not of limitation, and the scope of the invention is defined solely by the appended claims and their legal equivalents when properly read in light of the preceding description. For example, although the present description illustrates the invention as embodied in a rectangular or square carrier housing, the invention is not so limited. That is, the present invention contemplates the incorporation of RFID technology into any diminutive form factor presentable for transaction completion. Additionally, the present invention contemplates attaching an RFID module to an article using any of the attachment methods described herein without the use of a carrier housing.

What is claimed is:

1. A system configured to removably attach a radio frequency identification (RFID) transaction device to an article worn by a person, comprising:

an RFID module for sending transaction account information in response to an interrogation signal, wherein said transaction account information comprises a merchant code, a transaction account code and transaction data;

said RFID module comprising a secure memory, an authentication circuit, a modulator/demodulator, and a data memory capable of storing encrypted data related to payment information related to said person wearing said article, an authentication key and demographic information related to said person wearing said article, said RFID module configured to receive the interrogation signal from an RFID reader device for conducting mutual authentication using said authentication key, and transmit said payment information related to said person wearing said article, and said demographic information related to said person wearing said article to the RFID reader device, wherein said RFID reader device transmits said payment information and demographic information along with purchase data and a merchant code to a processor for authorization of said payment information and receives an authorization approval from said processor for use in completing a financial transaction, an RFID carrier housing encasing said RFID module, said RFID carrier housing comprising an attachment apparatus configured to attach said RFID carrier housing to said article worn by said person, wherein said attachment apparatus is operable to remove said RFID module from said article worn by said person, and wherein said attachment apparatus comprises a first string affixed to a first end of said RFID carrier housing and a second string affixed to a second end of said RFID carrier housing, wherein said attachment apparatus includes a sliding string fastener joining said first string to said second string at a substantially fixed location, said sliding string fastener operable to slide from a first end of said first string to a second end of said first string, and operable to slide from a first end of said second string to a second end of said second string, said sliding string fastener operable to tighten along the length of said first and second string.

2. The system of claim 1, wherein said attachment apparatus is configured to at least one of removably attach, permanently attach and partially attach said RFID carrier housing to said article.

3. The system of claim 1, wherein said attachment apparatus comprises an adhesive pad, affixed to said RFID carrier housing for use in adhering said RFID carrier housing to said article.

4. The system of claim 1, wherein said attachment apparatus comprises an attachment apparatus housing including a first elastic band configured to affix said RFID carrier housing to said article, and a coil spring affixed to said elastic band configured to retract said elastic band into said attachment apparatus housing.

5. The system of claim 1, wherein said attachment apparatus comprises an elastic band affixed to said RFID carrier housing configured to affix said RFID carrier housing to said article, wherein a first end of said elastic band is affixed to said RFID carrier housing and a second end of said elastic band is affixed to the second end of said RFID carrier housing, said first end of said elastic band and said second end of said elastic band forming a loop for insertion of said article.

6. The system of claim 1, wherein said attachment apparatus comprises a string configured to affix said RFID carrier housing to said article, and wherein a first end of said string is affixed to the first end of said RFID carrier housing and a second end of said string is affixed to the second end of said RFID carrier housing forming a loop, and a sliding string fastener for fixing an area of said loop.

7. The system of claim 1, wherein said attachment apparatus comprises a spring biased clamp, said spring biased clamp including a first clamp jaw in abutment with a second clamp jaw opposing said first clamp jaw, wherein said spring facilitates an abutment of said first clamp jaw and said second clamp jaw.

8. The system of claim 1, wherein said attachment apparatus comprises a molded clip, said molded clip including a first clip jaw in proximity to a second clip jaw, said first clip jaw and said second clip jaw held in proximity one to another.

9. The system of claim 1, wherein said attachment apparatus comprises an inlay for at least one of holding, enclosing, and supporting said RFID module.

10. A method for attaching an RFID transaction device to an article worn by a person, said method comprising:

affixing an attachment apparatus to said RFID transaction device, wherein said RFID transaction device comprises a secure memory, an authentication circuit, a modulator/demodulator, and a data memory capable of storing encrypted data, and said RFID device configured to receive an interrogation signal from said RFID reader device for conducting mutual authentication using an authentication key, and transmit payment information related to said person wearing said article and demographic information related to said person wearing said article to the RFID reader device, wherein said RFID reader device transmits said payment information and demographic information along with purchase data and a merchant code to a processor for authorization of said payment information and receives an authorization approval from said processor for use in completing a financial transaction, attaching said RFID transaction device to said article worn by the person, using said attachment apparatus, an RFID transaction device housing encasing said RFID transaction device, and wherein said attachment apparatus comprises a first string affixed to a first end of said RFID housing and a second string affixed to a second end of said RFID housing, wherein said attachment apparatus includes a sliding string fastener joining said first string to said second string at a substantially fixed location, said sliding string fastener operable to slide from a first end of said first string to a second end of said first string, and operable to slide from a first end of said second string to a second end of said second string, said sliding string fastener operable to tighten along the length of said first and second string.

11. The method of claim 10, wherein said step of attaching said RFID transaction device comprising at least one of removably attaching, permanently attaching and partially attaching said RFID transaction device.

12. The method of claim 10, wherein said step of affixing said attachment apparatus to said RFID transaction device comprises affixing an elastic band to the RFID transaction device housing forming a loop and attaching said RFID transaction device to said article by placing said article in said loop such that said elastic band surrounds said article.

13. The method of claim 10, wherein said step of affixing said attachment apparatus to said RFID transaction device includes affixing the first string and the second string to the RFID transaction device housing forming a loop and attaching said RFID transaction device to said article by using a fastener to adjust a circumference of said loop around said article.

14. The method of claim 10, wherein said step of affixing said attachment apparatus to said RFID transaction device includes affixing a spring biased clamp to the RFID transaction device housing and attaching said RFID transaction device to said article by placing gripping jaws of said spring biased clamp in non-abutment and inserting said article.

15. The method of claim 10, wherein said step of affixing said attachment apparatus to said RFID transaction device includes attaching a molded clip to the RFID transaction device housing, wherein said molded clip includes a first molded clip jaw molded in proximity to a second molded clip jaw thereby creating a passageway therebetween, and attaching said RFID transaction device to said article by placing said article in said passageway.

16. The method of claim 10, wherein said step of attaching said RFID transaction device to said article comprises inlaying said RFID transaction device substantially within a portion of said article.

* * * * *

UNITED STATES PATENT AND TRADEMARK OFFICE

CERTIFICATE OF CORRECTION

PATENT NO. : 7,429,927 B2
APPLICATION NO. : 11/161105
DATED : September 30, 2008
INVENTOR(S) : David S. Bonalle, et al.

It is certified that error appears in the above-identified patent and that said Letters Patent is hereby corrected as shown below:

On the Title Page, item (54) and Col. 1 Title, please delete "AND" and insert therefor --AN--.

Signed and Sealed this

Thirtieth Day of December, 2008

JON W. DUDAS
*Director of the United States Patent and Trademark Office*